US011742558B2

(12) United States Patent
Ogawa

(10) Patent No.: US 11,742,558 B2
(45) Date of Patent: Aug. 29, 2023

(54) FILTER

(71) Applicant: Soshin Electric Co., Ltd., Saku (JP)

(72) Inventor: Keisuke Ogawa, Otsu (JP)

(73) Assignee: Soshin Electric Co., Ltd, Saku (JP)

( * ) Notice: Subject to any disclaimer, the term of this patent is extended or adjusted under 35 U.S.C. 154(b) by 277 days.

(21) Appl. No.: 17/263,615

(22) PCT Filed: Jul. 23, 2019

(86) PCT No.: PCT/JP2019/028793
§ 371 (c)(1),
(2) Date: Jan. 27, 2021

(87) PCT Pub. No.: WO2020/026889
PCT Pub. Date: Feb. 6, 2020

(65) Prior Publication Data

US 2021/0296748 A1 Sep. 23, 2021

(30) Foreign Application Priority Data

Aug. 1, 2018 (JP) ..... 2018-144815

(51) Int. Cl.
*H01P 1/203* (2006.01)
*H01P 7/08* (2006.01)

(52) U.S. Cl.
CPC ..... *H01P 1/20327* (2013.01); *H01P 7/08* (2013.01)

(58) Field of Classification Search
CPC .. H01P 1/20345; H01P 1/20336; H01P 1/203; H01P 1/20327; H01P 1/202;
(Continued)

(56) References Cited

U.S. PATENT DOCUMENTS 5,764,118 A 6/1998 Saito et al.
5,945,892 A 8/1999 Kato et al.
(Continued)

FOREIGN PATENT DOCUMENTS

CN 105762467 A 7/2016
JP H07-086807 A1 3/1995
(Continued)

OTHER PUBLICATIONS

International Search Report and Written Opinion (Application No. PCT/JP2019/028793) dated Aug. 20, 2019.
(Continued)

*Primary Examiner* — Stephen E. Jones
(74) *Attorney, Agent, or Firm* — Burr Patent Law, PLLC

(57) ABSTRACT

The present invention provides a small-sized filter which has good characteristics. A filter according to the present invention comprises: a resonator which has a via electrode part that is formed within a dielectric substrate and a first strip line that is connected to one end of the via electrode part, while facing a first shielding conductor among a plurality of shielding conductors that are formed so as to surround the via electrode part; an input/output terminal which is coupled to a second shielding conductor among the plurality of shielding conductors; and a first capacitor electrode pattern which is coupled to the input/output terminal. The first capacitor electrode pattern is capacitively coupled to the first strip line or a second capacitor electrode pattern that is connected to the via electrode part.

13 Claims, 29 Drawing Sheets

(58) Field of Classification Search
CPC .. H01P 1/20; H01P 1/201; H01P 7/082; H01P 7/04; H01P 7/08; H01P 7/10; H03H 7/01; H03H 7/0115; H03H 7/0123
See application file for complete search history.

(56) References Cited

U.S. PATENT DOCUMENTS

| | | | |
|---|---|---|---|
| 6,965,284 | B2 | 11/2005 | Maekawa et al. |
| 2002/0030561 | A1 | 3/2002 | Masuda et al. |
| 2013/0076454 | A1 | 3/2013 | Imamura |

FOREIGN PATENT DOCUMENTS

| | | | |
|---|---|---|---|
| JP | H09-191206 | A1 | 7/1997 |
| JP | 2002-094349 | A1 | 3/2002 |
| JP | 2013-070288 | A1 | 4/2013 |
| JP | 2017-195565 | A1 | 10/2017 |

OTHER PUBLICATIONS

Japanese Office Action (Application No. 2018-144815) dated Aug. 11, 2020 (with English translation).
Chinese Office Action (Application No. 201980050777.X) dated Jul. 5, 2021 (with English translation).
German Office Action (with English translation) dated Feb. 15, 2023 (Application No. 11 2019 003 857.5).

FILTER

TECHNICAL FIELD

The present invention relates to a filter.

BACKGROUND ART

There have been proposed filters that have had provided therein between an input/output terminal and an LC resonance circuit a parallel resonance trap circuit configured by parallel connection of an inductor and a capacitor (Japanese Laid-Open Patent Publication No. 2002-094349 and Japanese Laid-Open Patent Publication No. 2013-070288). In such filters, due to the parallel resonance trap circuit being provided between the input/output terminal and the LC resonance circuit, a required attenuation amount is secured for a desired frequency, and impedance adjustment within a pass band is possible.

SUMMARY OF INVENTION

However, the filters that have been proposed in Japanese Laid-Open Patent Publication No. 2002-094349 and Japanese Laid-Open Patent Publication No. 2013-070288 require a resonance circuit to be newly added, and require a region for forming such a resonance circuit, hence a requirement of downsizing cannot be sufficiently fulfilled.

An object of the present invention is to provide a filter which is small-sized and has good characteristics.

A filter according to an aspect of the present invention includes: a resonator, the resonator including a via electrode portion which is formed within a dielectric substrate, and the resonator including a first strip line which is connected to one end of the via electrode portion and which faces a first shielding conductor among a plurality of shielding conductors that are formed so as to surround the via electrode portion; an input/output terminal which is coupled to a second shielding conductor among the plurality of shielding conductors; and a first capacitor electrode pattern which is coupled to the input/output terminal, the first capacitor electrode pattern being capacitively coupled to a second capacitor electrode pattern which is connected to the via electrode portion, or being capacitively coupled to the first strip line.

Due to the present invention, there can be provided a filter which is small-sized and has good characteristics.

DESCRIPTION OF EMBODIMENTS

Preferred embodiments of a filter according to the present invention will be presented and described in detail below with reference to the accompanying drawings.

First Embodiment

Figure 1:
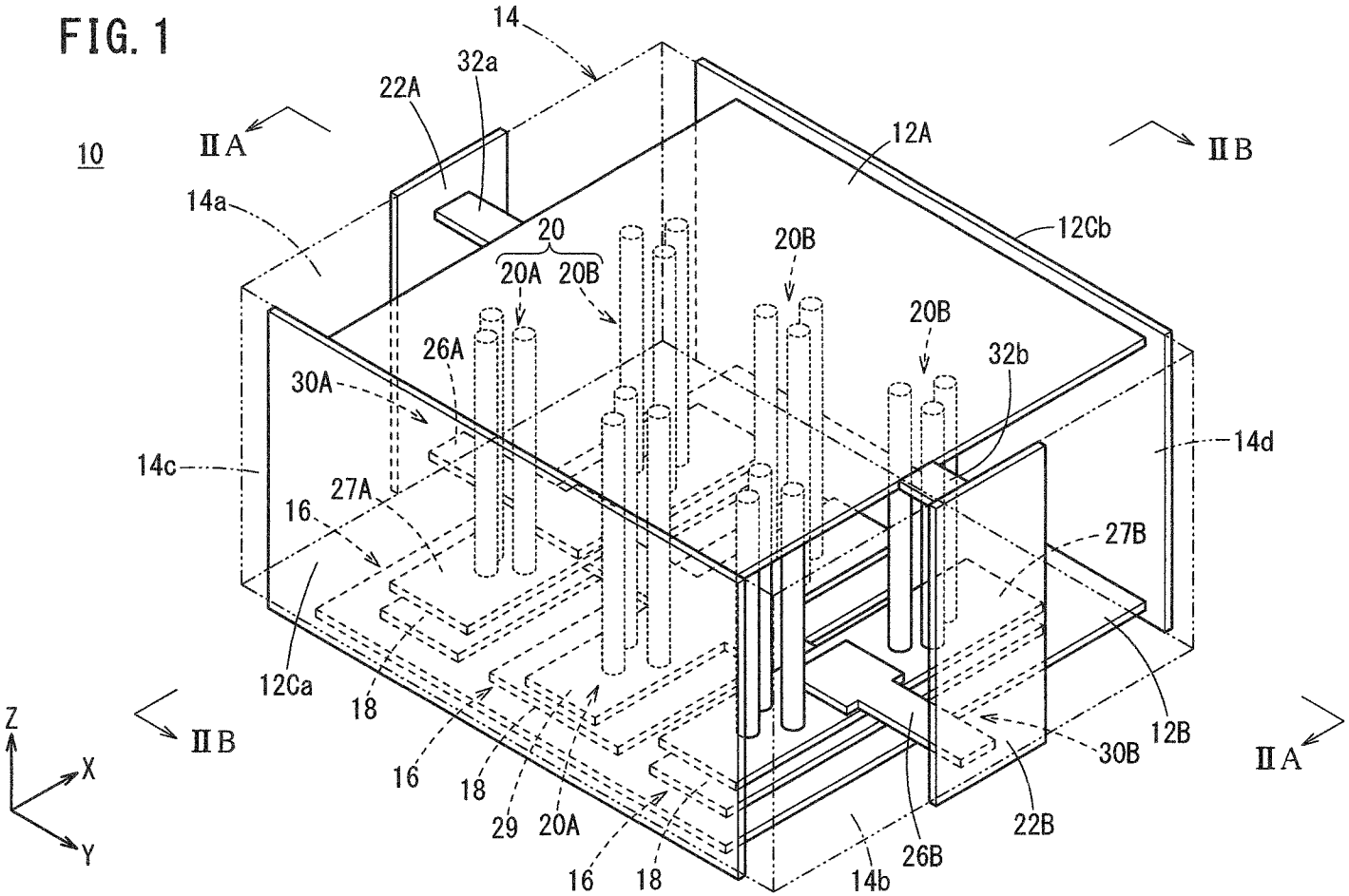
FIG. 1 is a perspective view showing a filter according to a first embodiment.
Figure 2A:
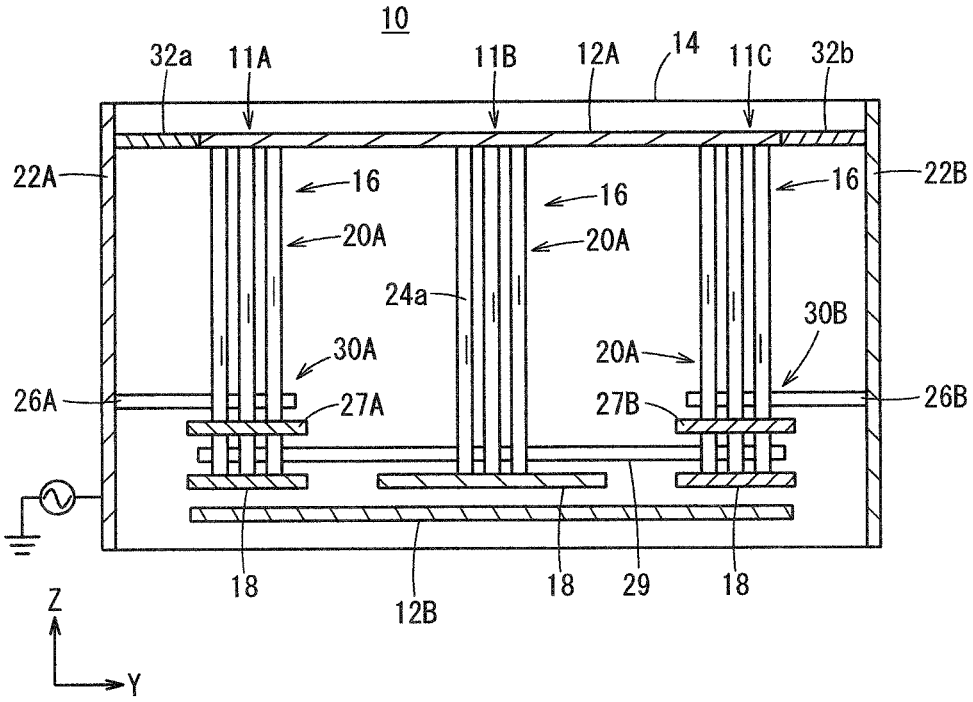
FIGS. 2A and 2B are cross-sectional views showing the filter according to the first embodiment.
Figure 2B:
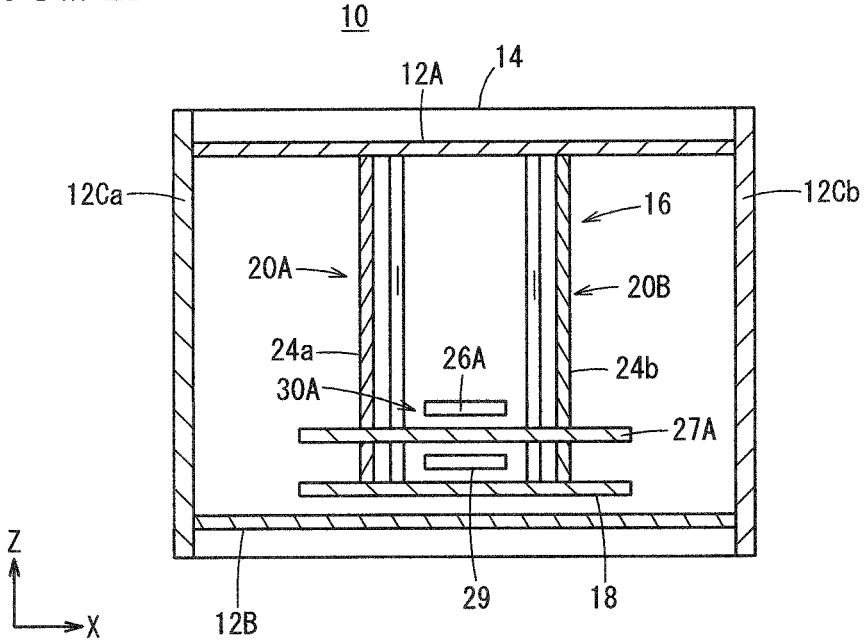
Figure 3:
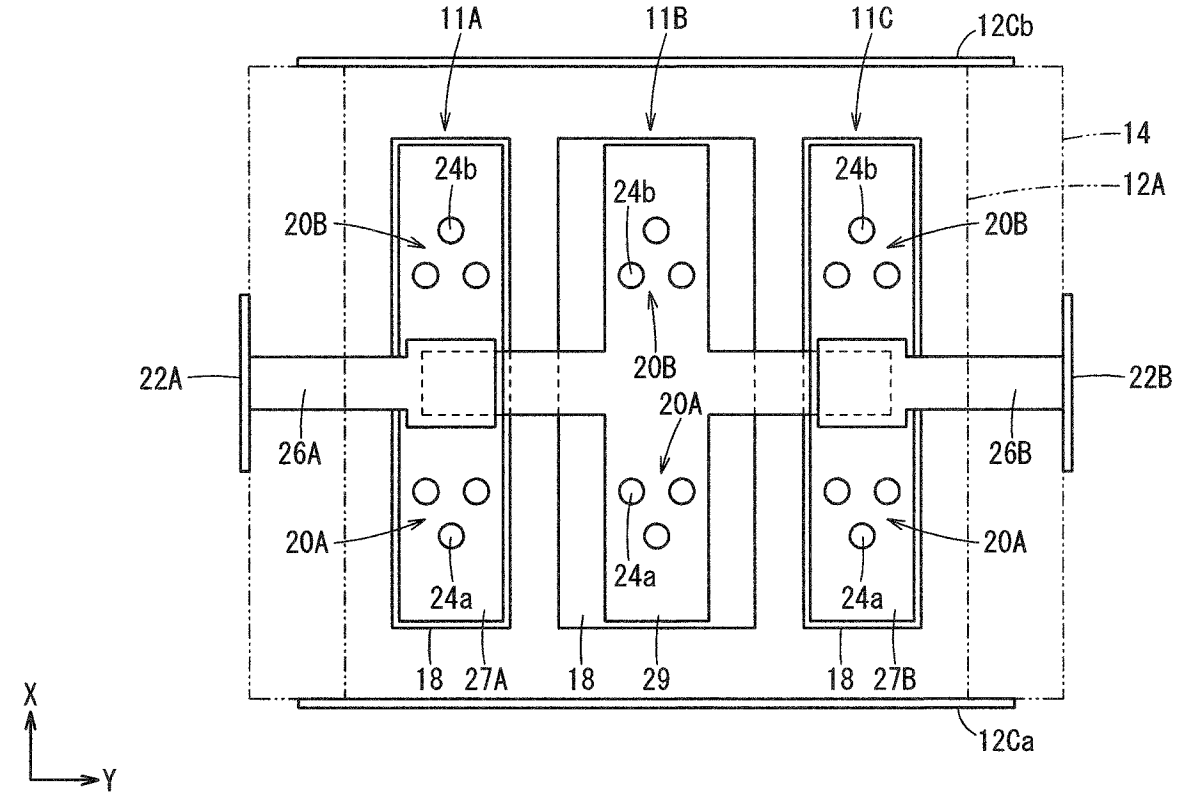
FIG. 3 is a plan view showing the filter according to the first embodiment.

A filter according to a first embodiment will be described using the drawings. FIG. 1 is a perspective view showing the filter according to the present embodiment. FIGS. 2A and 2B are cross-sectional views showing the filter according to the present embodiment. FIG. 2A corresponds to the line IIA-IIA of FIG. 1. FIG. 2B corresponds to the line IIB-IIB of FIG. 1. FIG. 3 is a plan view showing the filter according to the present embodiment.

As shown in FIG. 1, a filter 10 according to the present embodiment includes a dielectric substrate 14. The dielectric substrate 14 is formed in a parallelepiped shape, for example. The dielectric substrate 14 is configured by laminating a plurality of ceramics sheets (dielectric ceramics sheets).

On one principal surface side of the dielectric substrate 14, that is, an upper side of the dielectric substrate 14 in FIG. 1, there is formed an upper shielding conductor (a shielding conductor, a second shielding conductor) 12A. On the other principal surface side of the dielectric substrate 14, that is, a lower side of the dielectric substrate 14 in FIG. 1, there is formed a lower shielding conductor (a shielding conductor, a first shielding conductor) 12B.

The dielectric substrate 14 has formed therein a strip line (a first strip line) 18 that faces the lower shielding conductor 12B.

The dielectric substrate 14 has further formed therein a via electrode portion 20. The via electrode portion 20 includes a first via electrode portion (a via electrode portion) 20A and a second via electrode portion (a via electrode portion) 20B. One end of the via electrode portion 20 is connected to the strip line 18. The other end of the via electrode portion 20 is connected to the upper shielding conductor 12A. Thus, the via electrode portion 20 is formed from the strip line 18 to the upper shielding conductor 12A. The strip line 18 and the via electrode portion 20 configure a structure 16. The filter 10 is provided with a plurality of resonators 11A to 11C (refer to FIG. 2A) each including the structure 16.

A first side surface 14*a* among the four side surfaces of the dielectric substrate 14 has formed thereon a first input/output terminal (an input/output terminal) 22A. A second side surface 14*b* facing the first side surface 14*a* has formed thereon a second input/output terminal 22B. The first input/output terminal 22A is coupled to the upper shielding conductor 12A via a first connection line 32*a*. Moreover, the second input/output terminal 22B is coupled to the upper shielding conductor 12A via a second connection line 32*b*. A third side surface 14*c* among the four side surfaces of the dielectric substrate 14 has formed thereon a first side surface shielding conductor (a shielding conductor) 12Ca. A fourth side surface 14*d* facing the third side surface 14*c* has formed thereon a second side surface shielding conductor (a shielding conductor) 12Cb. In the dielectric substrate 14, the first via electrode portion 20A is positioned on a first side surface shielding conductor 12Ca side, and the second via electrode portion 20B is positioned on a second side surface shielding conductor 12Cb side. Note that although there will be described here as an example the case where the first input/output terminal 22A is connected to the upper shielding conductor 12A via the first connection line 32*a*, the present embodiment is not limited to this. For example, a configuration may be adopted whereby the first input/output terminal 22A is coupled to the upper shielding conductor 12A via the first connection line 32*a* and an unillustrated gap. Such a gap may be configured so as to be formed between the first input/output terminal 22A and the first connection line 32*a*, or may be configured so as to be formed between the first connection line 32*a* and the upper shielding conductor 12A. Moreover, although there will be described here as an example the case where the second input/output terminal 22B is connected to the upper shielding conductor 12A via the second connection line 32*b*, the present embodiment is not limited to this. For example, a configuration may be adopted whereby the second input/output terminal 22B is coupled to the upper shielding conductor 12A via the second connection line 32*b* and an unillustrated gap. Such a gap may be configured so as to be formed between the second input/output terminal 22B and the second connection line 32*b*, or may be configured so as to be formed between the second connection line 32*b* and the upper shielding conductor 12A.

The first via electrode portion 20A is configured from a plurality of first via electrodes (via electrodes) 24*a*. The second via electrode portion 20B is configured from a plurality of second via electrodes (via electrodes) 24*b*. The first via electrodes 24*a* and the second via electrodes 24*b* are each embedded in a via hole formed in the dielectric substrate 14. No other via electrode portion exists between the first via electrode portion 20A and the second via electrode portion 20B.

In the dielectric substrate 14, there are further formed a capacitor electrode pattern (a first capacitor electrode pattern) 26A and a capacitor electrode pattern 26B. The capacitor electrode pattern 26A is connected to the first input/output terminal 22A. The capacitor electrode pattern 26B is connected to the second input/output terminal 22B. Note that although there will be described here as an example the case where the capacitor electrode pattern 26A is connected to the first input/output terminal 22A, the present embodiment is not limited to this. A configuration may be adopted whereby the capacitor electrode pattern 26A is coupled to the first input/output terminal 22A via an unillustrated gap. Moreover, although there will be described here as an example the case where the capacitor electrode pattern 26B is connected to the second input/output terminal 22B, the present embodiment is not limited to this. A configuration may be adopted whereby the capacitor electrode pattern 26B is coupled to the second input/output terminal 22B via an unillustrated gap. The via electrode portion 20 of the resonator 11A is connected with a capacitor electrode pattern (a second capacitor electrode pattern) 27A. The capacitor electrode pattern 27A faces the strip line 18 of the resonator 11A. An upper surface of the capacitor electrode pattern 27A is connected to the upper shielding conductor 12A by a portion other than a lower portion of the via electrode portion 20 of the resonator 11A. Now, a lower portion of the via electrode portion 20 of the resonator 11A refers to a portion existing between a lower surface of the capacitor electrode pattern 27A and an upper surface of the strip line 18, of the via electrode portion 20. The lower surface of the capacitor electrode pattern 27A is connected to the strip line 18 of the resonator 11A by the lower portion of the via electrode portion 20 of the resonator 11A. The via electrode portion 20 of the resonator 11C is connected with a capacitor electrode pattern 27B. The capacitor electrode pattern 27B faces the strip line 18 of the resonator 11C. An upper surface of the capacitor electrode pattern 27B is connected to the upper shielding conductor 12A by a portion other than a lower portion of the via electrode portion 20 of the resonator 11C. A lower surface of the capacitor electrode pattern 27B is connected to the strip line 18 of the resonator 11C by the lower portion of the via electrode portion 20 of the resonator 11C.

Part of the capacitor electrode pattern 26A faces part of the capacitor electrode pattern 27A. Part of the capacitor electrode pattern 26B faces part of the capacitor electrode pattern 27B. The capacitor electrode pattern 26A extends to the first input/output terminal 22A from a position above the capacitor electrode pattern 27A between the first via electrode portion 20A and the second via electrode portion 20B. The capacitor electrode pattern 26B extends to the second input/output terminal 22B from a position above the capacitor electrode pattern 27B between the first via electrode portion 20A and the second via electrode portion 20B. Note that the capacitor electrode pattern 26A may be formed so as to extend to the first input/output terminal 22A from a position below the capacitor electrode pattern 27A between the first via electrode portion 20A and the second via electrode portion 20B. Moreover, the capacitor electrode pattern 26B may be formed so as to extend to the second input/output terminal 22B from a position below the capacitor electrode pattern 27B between the first via electrode portion 20A and the second via electrode portion 20B. The capacitor electrode pattern 26A, the capacitor electrode pattern 27A, and a dielectric existing therebetween configure a capacitor 30A. The capacitor electrode pattern 26B, the capacitor electrode pattern 27B, a dielectric existing therebetween configure a capacitor 30B.

In the dielectric substrate 14, there is further provided a coupling capacitance electrode 29. In the example shown in FIGS. 2A and 2B, part of the coupling capacitance electrode 29 faces the strip line 18 of the resonator 11B. The via electrode portion 20 of the resonator 11B is connected with the coupling capacitance electrode 29. The coupling capacitance electrode 29 is connected to the upper shielding conductor 12A by a portion other than a lower portion of the via electrode portion 20 of the resonator 11B. The coupling capacitance electrode 29 is connected to the strip line 18 of the resonator 11B by the lower portion of the via electrode portion 20 of the resonator 11B. The coupling capacitance electrode 29 extends from a position above the strip line 18 of the resonator 11B to a position above the strip line 18 between the first via electrode portion 20A of the resonator 11A and the second via electrode portion 20B of the resonator 11A. A portion of the coupling capacitance electrode 29 facing the strip line 18 of the resonator 11A is positioned between the strip line 18 of the resonator 11A and the capacitor electrode pattern 27A positioned above the strip line 18. The coupling capacitance electrode 29 extends from a position above the strip line 18 of the resonator 11B to a position above the strip line 18 between the first via electrode portion 20A of the resonator 11C and the second via electrode portion 20B of the resonator 11C. A portion of the coupling capacitance electrode 29 facing the strip line 18 of the resonator 11C is positioned between the strip line 18 of the resonator 11C and the capacitor electrode pattern 27B positioned above the strip line 18.

Figure 4:
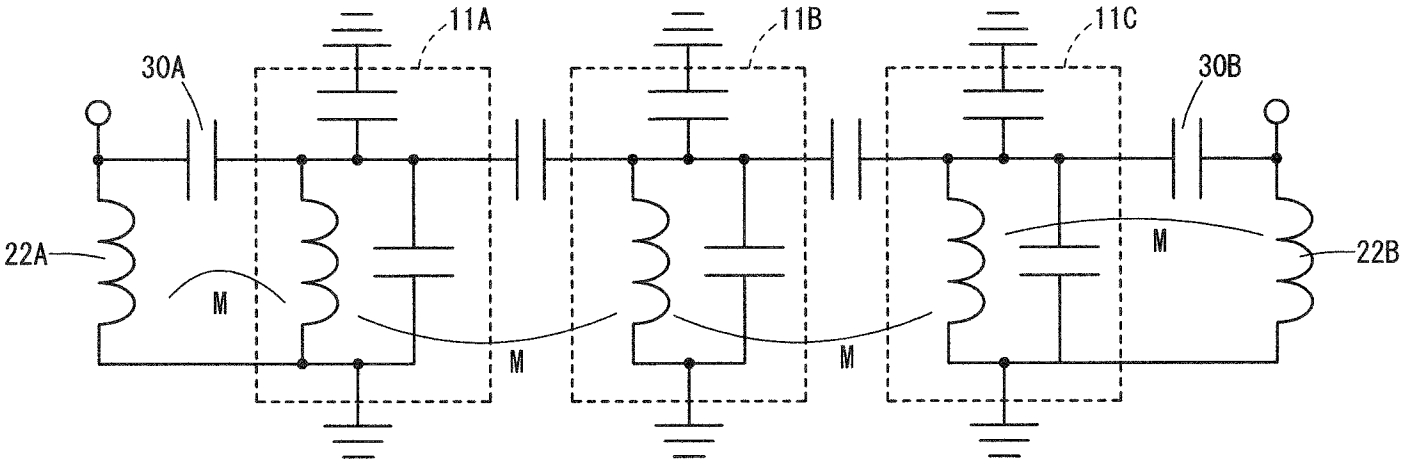
FIG. 4 is a view showing an equivalent circuit of the filter according to the first embodiment.

FIG. 4 is a view showing an equivalent circuit of the filter according to the present embodiment. As shown in FIG. 4, in the present embodiment, the capacitor 30A exists between the first input/output terminal 22A and the resonator 11A. Moreover, as shown in FIG. 4, in the present embodiment, the capacitor 30B exists between the second input/output terminal 22B and the resonator 11C.

Figure 5:
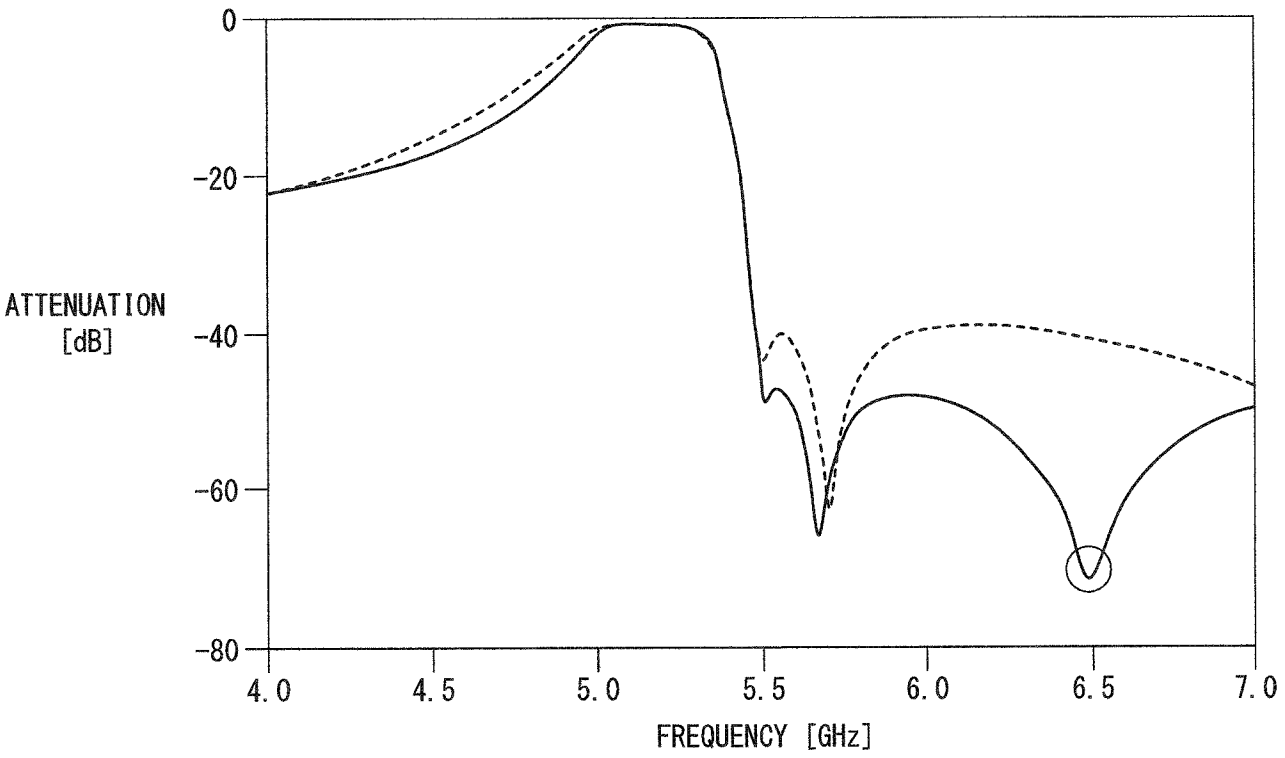
FIG. 5 is a graph showing an example of attenuation characteristics of the filter according to the first embodiment.

The first input/output terminal 22A and the resonator 11A are magnetic field-coupled. Moreover, due to the capacitor 30A being added between the first input/output terminal 22A and the resonator 11A, the first input/output terminal 22A and the resonator 11A are electromagnetic field-coupled. Control of an attenuation pole of the filter 10 becomes possible due to the capacitor 30A added between the first input/output terminal 22A and the resonator 11A. In addition, the second input/output terminal 22B and the resonator 11C are magnetic field-coupled. Moreover, due to the capacitor 30B being added between the second input/output terminal 22B and the resonator 11C, the second input/output terminal 22B and the resonator 11C are electromagnetic field-coupled. Control of an attenuation pole of the filter 10 becomes possible due to the capacitor 30B added between the second input/output terminal 22B and the resonator 11C. FIG. 5 is a graph showing an example of attenuation characteristics of the filter according to the present embodiment. The horizontal axis of FIG. 5 indicates frequency, and the vertical axis of FIG. 5 indicates attenuation. The solid line indicates an example of the case of the present embodiment, that is, the case where the capacitors 30A, 30B are provided. The broken line indicates an example of the case of reference example 1, that is, the case where the capacitors 30A, 30B are not provided. The portion surrounded by a circle in FIG. 5 indicates the attenuation pole. As may be understood from FIG. 5, providing the capacitors 30A, 30B enables a desired attenuation pole at a desired frequency position to be formed in a vicinity of a pass band. Since providing the capacitors 30A, 30B enables a desired attenuation pole at a desired frequency position to be formed in a vicinity of a pass band, the present embodiment enables a filter 10 having good characteristics to be obtained. Note that the frequency position of the attenuation pole is adjustable by appropriately setting respective electrostatic capacitances of the capacitors 30A, 30B.

Figure 6:
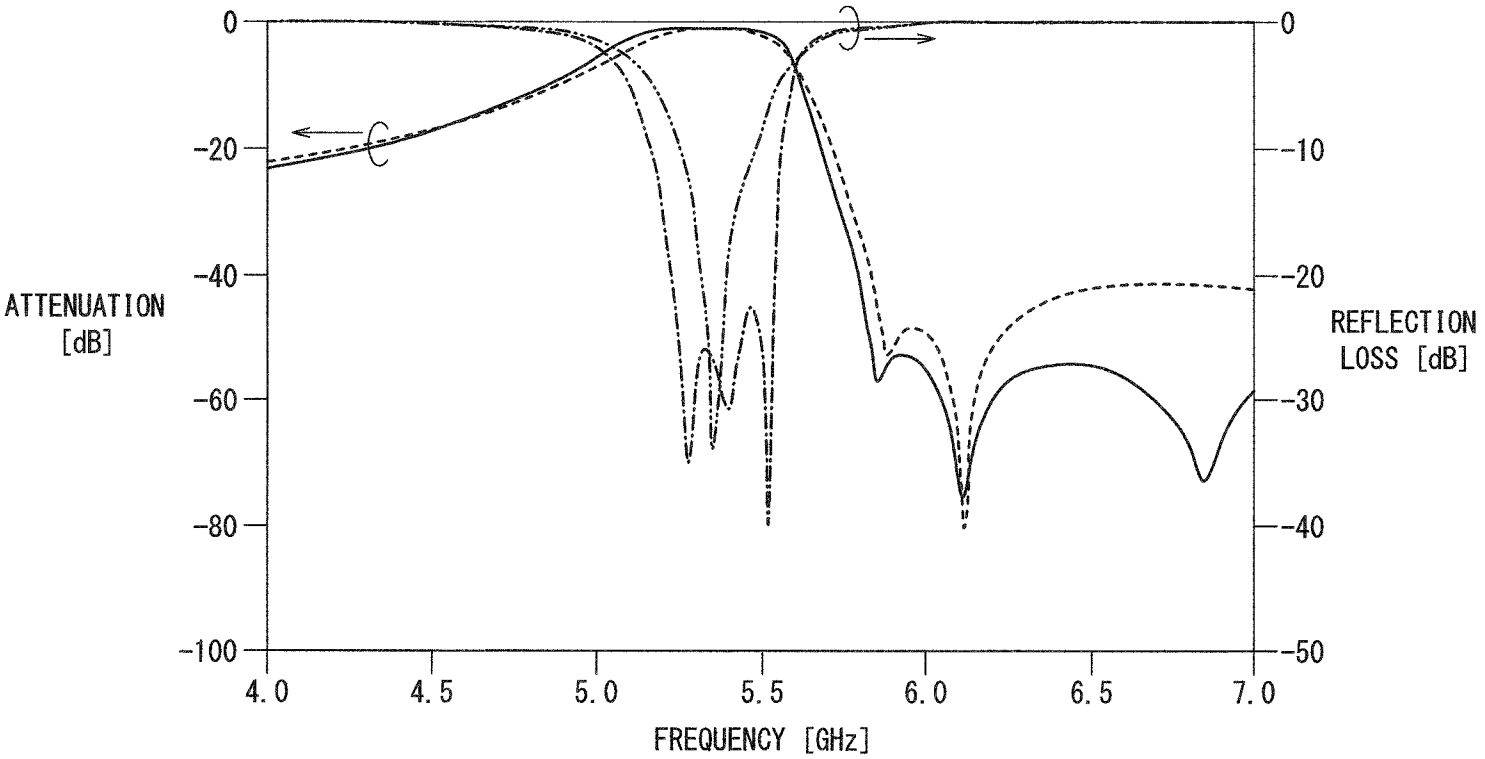
FIG. 6 is a graph showing an example of attenuation characteristics and reflection loss characteristics of the filter according to the first embodiment.
Figure 7:
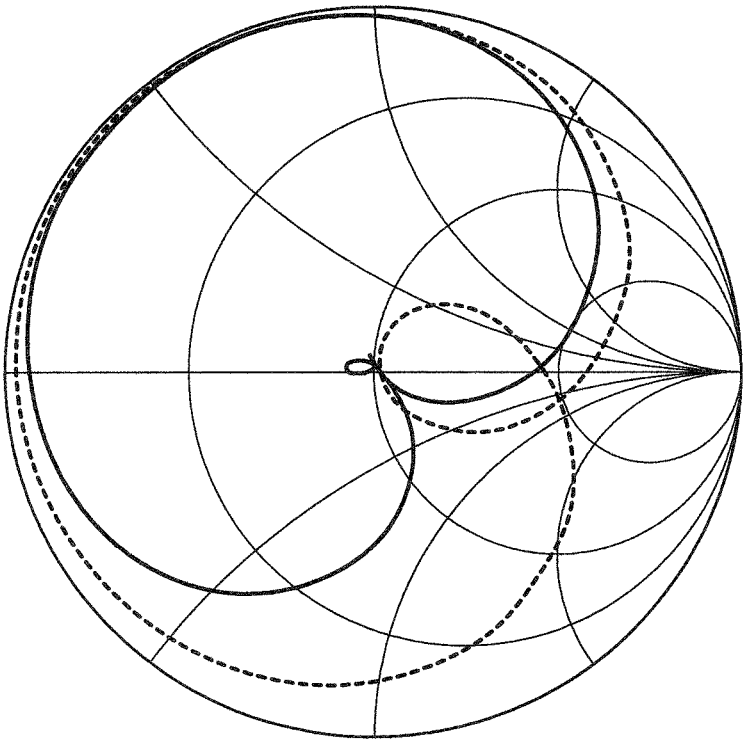
FIG. 7 is a Smith chart showing an example of an input reflection coefficient of the filter according to the first embodiment.

Moreover, in the present embodiment, the capacitor 30A provided between the first input/output terminal 22A and the resonator 11A enables input/output impedance to be adjusted. Moreover, in the present embodiment, the capacitor 30B provided between the second input/output terminal 22B and the resonator 11C enables input/output impedance to be adjusted. FIG. 6 is a graph showing an example of attenuation characteristics and reflection loss characteristics of the filter according to the present embodiment. The horizontal axis of FIG. 6 indicates frequency, the vertical axis on the left side of FIG. 6 indicates attenuation, and the vertical axis on the right side of FIG. 6 indicates reflection loss. The solid line indicates an example of attenuation in the case of the present embodiment, that is, the case where the capacitors 30A, 30B are provided. The broken line indicates an example of attenuation in the case of reference example 1, that is, the case where the capacitors 30A, 30B are not provided. The one-dot chain line indicates an example of reflection loss in the case of the present embodiment, that is, the case where the capacitors 30A, 30B are provided. The two-dot chain line indicates an example of reflection loss in the case of reference example 1, that is, the case where the capacitors 30A, 30B are not provided. FIG. 7 is a Smith chart showing an example of an input reflection coefficient of the filter according to the present embodiment. FIG. 7 shows an input reflection coefficient (S11) in a frequency range of 4 GHz to 7 GHz. The solid line in FIG. 7 indicates an example of the case where the capacitors 30A, 30B are provided. The broken line in FIG. 7 indicates an example of the case where the capacitors 30A, 30B are not provided. As may be understood from the reflection loss in the range of, for example, 5.2 GHz to 5.5 GHz in FIG. 6, reflection characteristics in the pass band of the filter are improved more in the case of the capacitors 30A, 30B being provided, compared to the case of the capacitors 30A, 30B not being provided. Thus, due to the present embodiment being provided with the capacitors 30A, 30B, the present embodiment enables inconsistency of the input/output impedance of the filter 10 to be suppressed, and reflection characteristics in the pass band of the filter to be improved.

In the present embodiment, formation of a desired attenuation pole at a desired frequency position and adjustment of input/output impedance may be performed by a simple configuration. Hence, the present embodiment makes it possible to provide a filter 10 which is small-sized and has good characteristics.

Figure 8B:
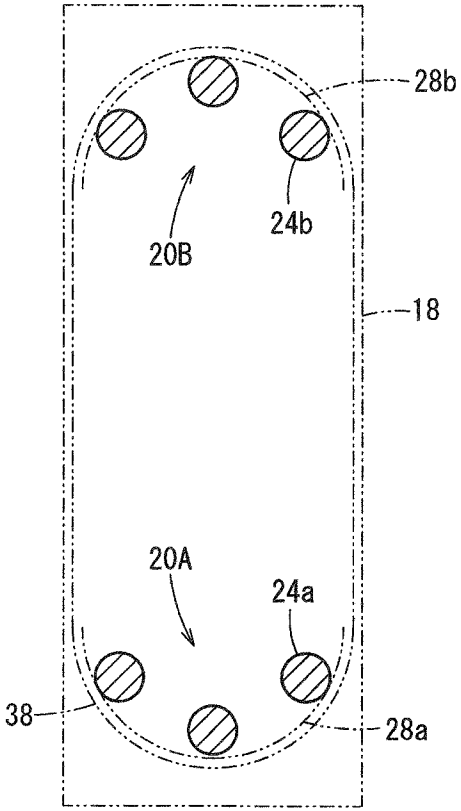
FIGS. 8A and 8B are plan views showing examples of disposition of a first via electrode and a second via electrode.
Figure 8A:
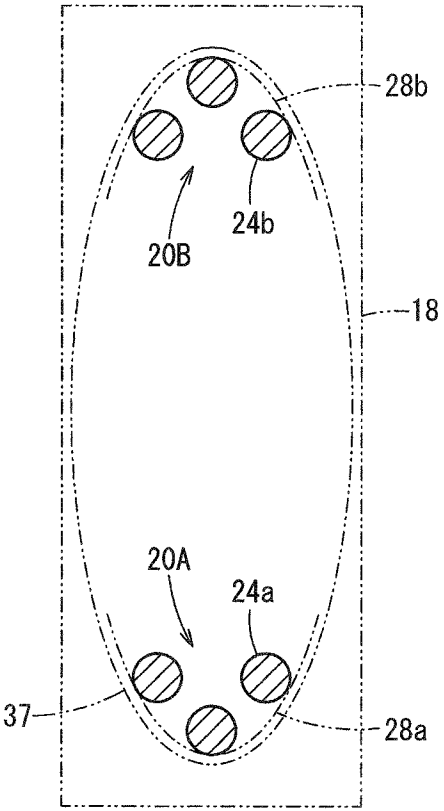

FIGS. 8A and 8B are plan views showing examples of disposition of the first via electrodes and the second via electrodes. FIG. 8A shows an example where the first via electrodes 24*a* and the second via electrodes 24*b* are disposed so as to lie along parts of an imaginary ellipse 37. FIG. 8B shows an example where the first via electrodes 24*a* and the second via electrodes 24*b* are disposed so as to lie along parts of an imaginary track shape 38. A track shape refers to a shape configured from two facing semicircular portions and two parallel straight-line portions connecting these semicircular portions.

In the example shown in FIG. 8A, the plurality of first via electrodes 24*a* are disposed along a first imaginary curved line 28*a* configuring part of the imaginary ellipse 37, when viewed from an upper surface. Moreover, in the example shown in FIG. 8A, the plurality of second via electrodes 24*b* are disposed along a second imaginary curved line 28*b* configuring part of the imaginary ellipse 37, when viewed from the upper surface. In the example shown in FIG. 8B, the plurality of first via electrodes 24*a* are disposed along a first imaginary curved line 28*a* configuring part of the imaginary track shape 38, when viewed from an upper surface. Moreover, in the example shown in FIG. 8B, the plurality of second via electrodes 24*b* are disposed along a second imaginary curved line 28*b* configuring part of the imaginary track shape 38, when viewed from the upper surface.

It is for the following reasons that the first via electrodes 24*a* and the second via electrodes 24*b* are disposed so as to lie along the imaginary ellipse 37 or the imaginary track shape 38. That is, in the case of the resonators 11A to 11C being multi-staged to configure the filter 10, if a diameter of the via electrode portion 20 is simply made larger, then an electric wall occurs between the resonators 11A to 11C, leading to a deterioration in Q-factor. In contrast, if the via electrode portion 20 is configured in an elliptical shape, and the resonators 11A to 11C are multi-staged in a short axis direction of the elliptical shape, then a distance between each other of the via electrode portions 20 becomes longer, hence the Q-factor can be improved. Moreover, if the via electrode portion 20 is configured in the track shape 38, and the resonators 11A to 11C are multi-staged in a direction perpendicular to a longitudinal direction of the straight-line portions of the imaginary track shape 38, then a distance between each other of the via electrode portions 20 becomes longer, hence the Q-factor can be improved. It is for such reasons that, in the present embodiment, the first via electrodes 24*a* and the second via electrodes 24*b* are disposed so as to lie along the imaginary ellipse 37 or the imaginary track shape 38.

Moreover, it is for the following reasons that the first via electrodes 24*a* and the second via electrodes 24*b* are respectively disposed in end portions of the imaginary ellipse 37, that is, both end portions where curvature is large, of the imaginary ellipse 37. Moreover, it is for the following reasons that the first via electrodes 24*a* and the second via electrodes 24*b* are respectively disposed in the semicircular portions of the imaginary track shape 38. That is, a high frequency current concentrates in the end portions of the imaginary ellipse 37, that is, both end portions where curvature is large, of the imaginary ellipse 37. Moreover, a high frequency current concentrates in both end portions of the imaginary track shape 38, that is, the semicircular portions of the imaginary track shape 38. Therefore, even if the via electrodes 24*a*, 24*b* are configured not to be disposed in a portion other than both end portions of the imaginary ellipse 37 or the imaginary track shape 38, it never leads to a significant lowering of the high frequency current. In addition, if the number of via electrodes 24*a*, 24*b* is reduced, a time required for forming the vias can be shortened, hence an improvement in throughput can be achieved. Moreover, if the number of via electrodes 24*a*, 24*b* is reduced, a material such as silver embedded in the vias may be reduced, hence a reduction in costs can also be achieved. Moreover, since a region where an electromagnetic field is comparatively sparse is formed between the first via electrode portion 20A and the second via electrode portion 20B, it is also possible for a strip line for coupling adjustment, and so on, to be formed in the region. It is from such viewpoints that, in the present embodiment, the first via electrodes 24*a* and the second via electrodes 24*b* are disposed in both end portions of the imaginary ellipse 37 or the imaginary track shape 38.

The via electrode portion 20 and the first side surface shielding conductor 12Ca and second side surface shielding conductor 12Cb behave like a semi-coaxial resonator. Orientation of current flowing in the via electrode portion 20 and orientation of current flowing in the first side surface shielding conductor 12Ca are opposite, and moreover, orientation of current flowing in the via electrode portion 20 and orientation of current flowing in the second side surface shielding conductor 12Cb are opposite. Therefore, an electromagnetic field can be confined in a portion surrounded by the shielding conductors 12A, 12B, 12Ca, 12Cb, and loss due to radiation can be reduced and effects on outside reduced. At a certain timing during resonance, current flows so as to diffuse from a center of the upper shielding conductor 12A to an entire surface of the upper shielding conductor 12A. At this time, current flows in the lower shielding conductor 12B so as to concentrate from an entire surface of the lower shielding conductor 12B toward a center of the lower shielding conductor 12B. Moreover, at another timing during resonance, current flows so as to diffuse from the center of the lower shielding conductor 12B to the entire surface of the lower shielding conductor 12B. At this time, current flows in the upper shielding conductor 12A so as to concentrate from the entire surface of the upper shielding conductor 12A toward the center of the upper shielding conductor 12A. The current flowing so as to diffuse to the entire surface of the upper shielding conductor 12A or lower shielding conductor 12B similarly flows, as is, in the first side surface shielding conductor 12Ca and second side surface shielding conductor 12Cb too. That is, the current flows in a conductor of broad line width. In a conductor of broad line width, a resistance component is small, hence deterioration in Q-factor is small. The first via electrode portion 20A and the second via electrode portion 20B realize a TEM wave resonator in conjunction with the shielding conductors 12A, 12B, 12Ca, 12Cb. That is, the first via electrode portion 20A and the second via electrode portion 20B realize a TEM wave resonator with reference to the shielding conductors 12A, 12B, 12Ca, 12Cb. The strip line 18 plays a role of forming open end capacitance. Each of the resonators 11A to 11C provided in the filter 10 may operate as a $\lambda/4$ resonator.

Thus, due to the present embodiment, the capacitor 30A is provided between the first input/output terminal 22A and the resonator 11A, and the capacitor 30B is provided between the second input/output terminal 22B and the resonator 11C. These capacitors 30A, 30B enable a desired attenuation pole at a desired frequency position to be formed in a vicinity of a pass band, hence the present embodiment enables a filter 10 having good characteristics to be obtained. Moreover, since input/output impedance can be adjusted by these capacitors 30A, 30B, the present embodiment enables inconsistency of input/output impedance to be suppressed. Moreover, such capacitors 30A, 30B have a simple configuration. Hence, the present embodiment makes it possible to provide a filter 10 which is small-sized and has good characteristics.

Modified Example 1

Figure 9A:
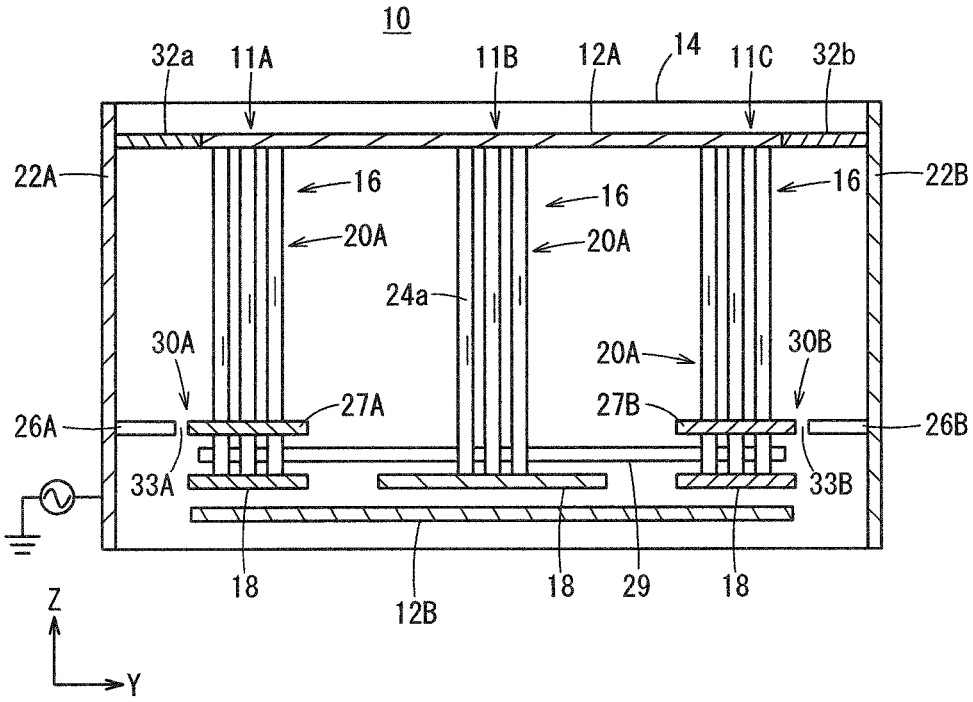
FIGS. 9A and 9B are cross-sectional views showing a filter according to modified example 1 of the first embodiment.
Figure 9B:
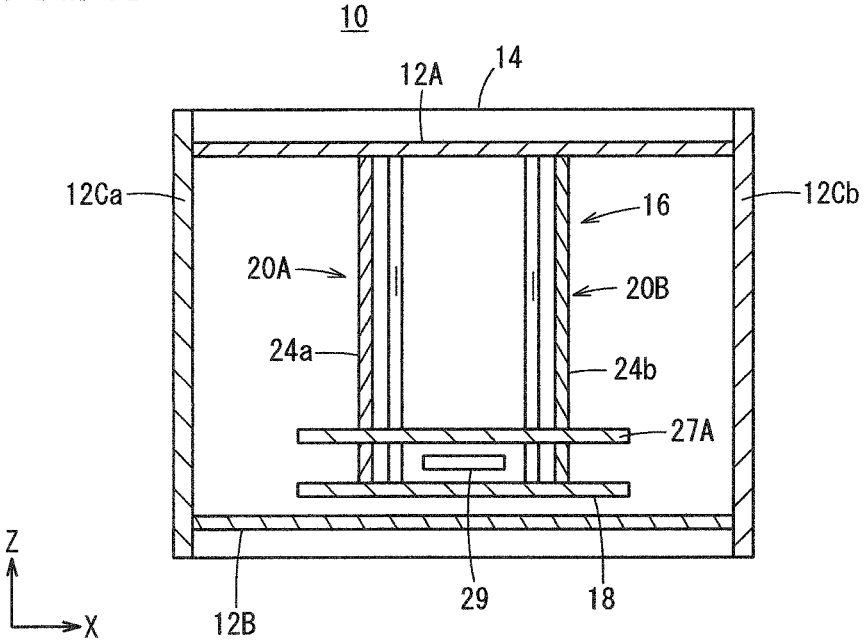
Figure 10:
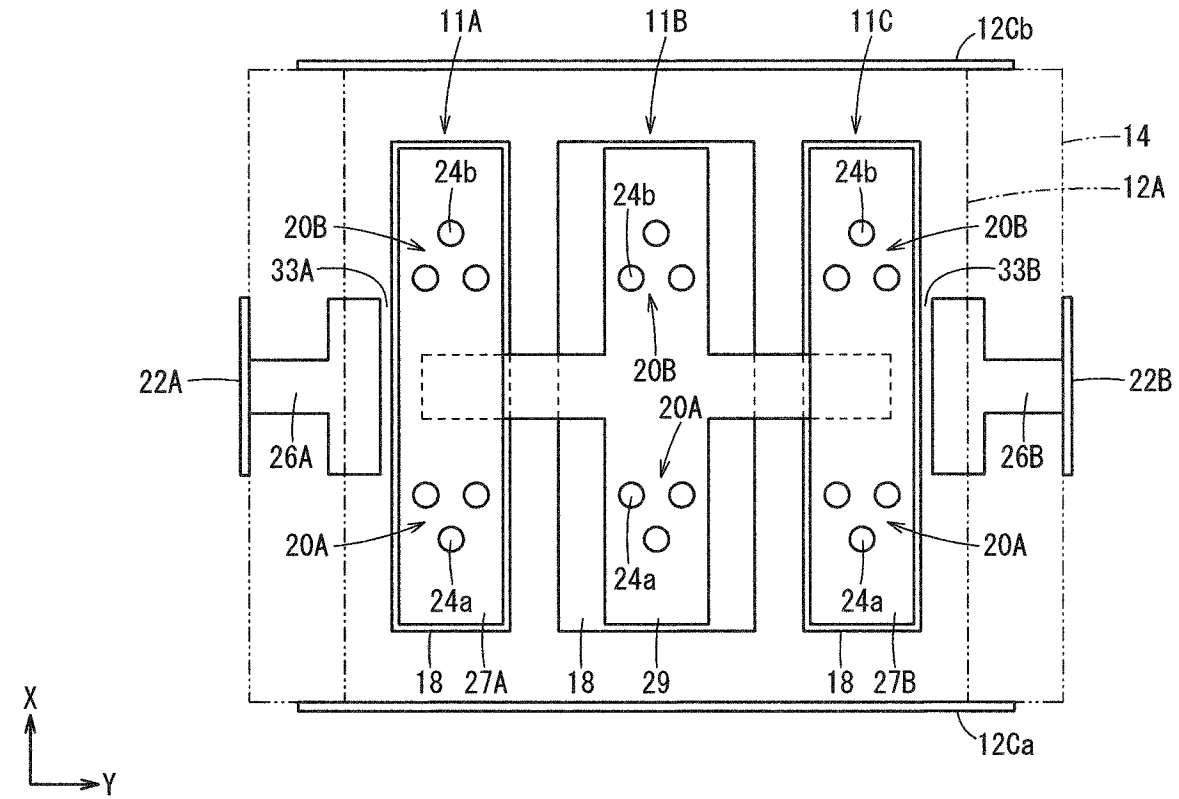
FIG. 10 is a plan view showing the filter according to modified example 1 of the first embodiment.

A filter according to modified example 1 of the present embodiment will be described using FIGS. 9A to 10. FIGS. 9A and 9B are cross-sectional views showing the filter according to the present modified example. FIG. 10 is a plan view showing the filter according to the present modified example.

The present modified example is one in which the capacitor electrode patterns 26A, 26B and the capacitor electrode patterns 27A, 27B are formed in the same layer. In the present modified example, the capacitor electrode patterns 26A, 26B are capacitively coupled to the capacitor electrode patterns 27A, 27B via gaps 33A, 33B.

The capacitor electrode pattern 27A is positioned above the strip line 18 of the resonator 11A. Moreover, the capacitor electrode pattern 27B is positioned above the strip line 18 of the resonator 11C. The coupling capacitance electrode 29 is formed in a layer between a layer where the strip lines 18 are formed and the layer where the capacitor electrode patterns 27A, 27B are formed. The coupling capacitance electrode 29 is connected to the upper shielding conductor 12A by a portion other than the lower portion of the via electrode portion 20 of the resonator 11B. The coupling capacitance electrode 29 is connected to the strip line 18 of the resonator 11B by the lower portion of the via electrode portion 20 of the resonator 11B. The coupling capacitance electrode 29 extends from a position above the strip line 18 between the first via electrode portion 20A of the resonator 11A and the second via electrode portion 20B of the resonator 11A, to above the strip line 18 of the resonator 11B. Moreover, the coupling capacitance electrode 29 extends from a position above the strip line 18 between the first via electrode portion 20A of the resonator 11C and the second via electrode portion 20B of the resonator 11C, to above the strip line 18 of the resonator 11B.

The capacitor electrode pattern 26A is formed in the same layer as the capacitor electrode pattern 27A. The gap 33A exists between the capacitor electrode pattern 26A and the capacitor electrode pattern 27A. The capacitor electrode pattern 26A is capacitively coupled to the capacitor electrode pattern 27A via the gap 33A.

The capacitor electrode pattern 26B is formed in the same layer as the capacitor electrode pattern 27B. The gap 33B exists between the capacitor electrode pattern 26B and the capacitor electrode pattern 27B. The capacitor electrode pattern 26B is capacitively coupled to the capacitor electrode pattern 27B via the gap 33B.

In this way, a configuration may be adopted whereby the capacitor electrode patterns 26A, 26B and the capacitor electrode patterns 27A, 27B are formed in the same layer. Moreover, a configuration may be adopted whereby the capacitor electrode patterns 26A, 26B are capacitively coupled to the capacitor electrode patterns 27A, 27B via the gaps 33A, 33B.

Modified Example 2

Figure 11A:
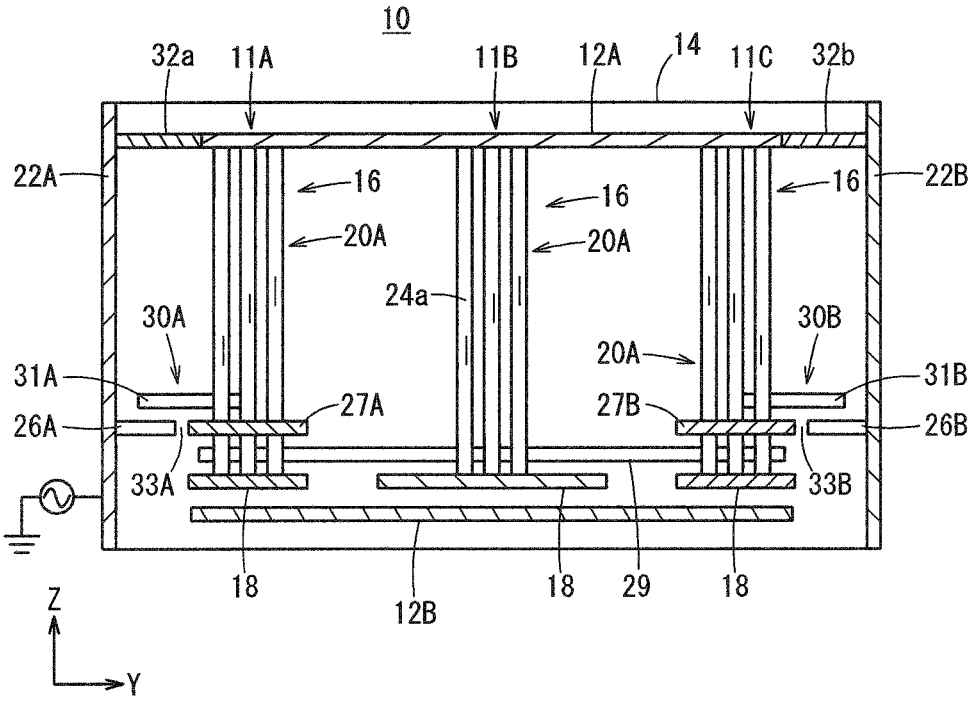
FIGS. 11A and 11B are cross-sectional views showing a filter according to modified example 2 of the first embodiment.
Figure 11B:
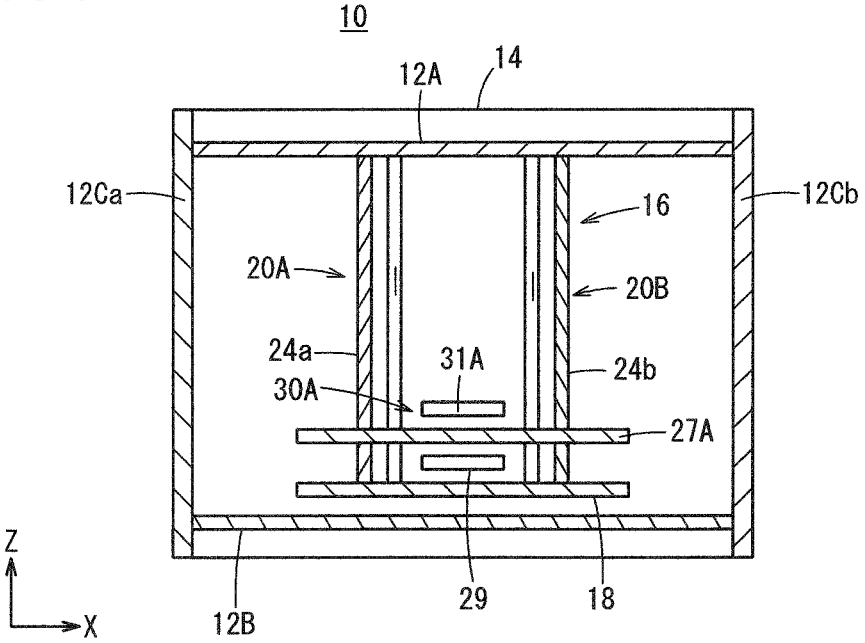
Figure 12:
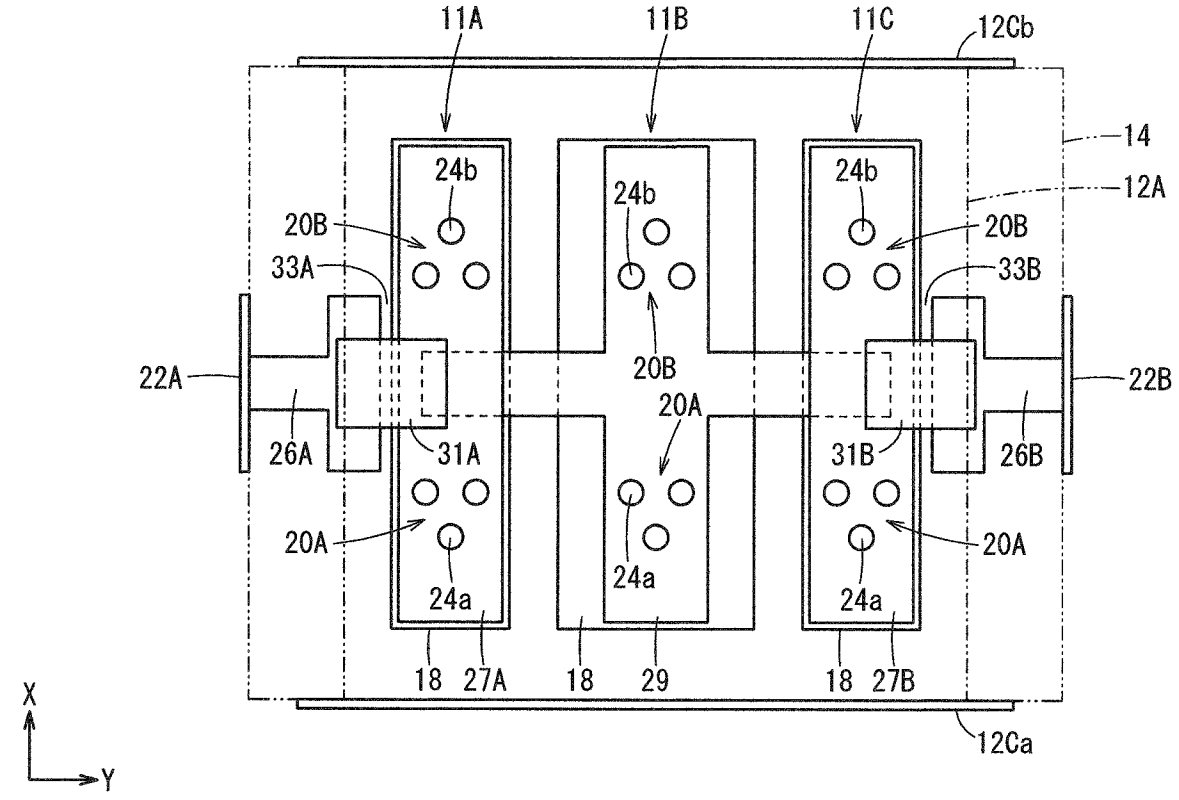
FIG. 12 is a plan view showing the filter according to modified example 2 of the first embodiment.

A filter according to modified example 2 of the present embodiment will be described using FIGS. 11A to 12. FIGS. 11A and 11B are cross-sectional views showing the filter according to the present modified example. FIG. 12 is a plan view showing the filter according to the present modified example.

The present modified example is one in which the capacitor electrode patterns 26A, 26B face coupling capacitance electrodes 31A, 31B that are formed so as to face the capacitor electrode patterns 27A, 27B.

The capacitor electrode pattern 27A is positioned above the strip line 18 of the resonator 11A. Moreover, the capacitor electrode pattern 27B is positioned above the strip line 18 of the resonator 11C. The coupling capacitance electrode 29 is formed in a layer between a layer where the strip lines 18 are formed and a layer where the capacitor electrode patterns 27A, 27B are formed. The coupling capacitance electrode 29 is connected to the upper shielding conductor 12A by a portion other than the lower portion of the via electrode portion 20 of the resonator 11B. The coupling capacitance electrode 29 is connected to the strip line 18 of the resonator 11B by the lower portion of the via electrode portion 20 of the resonator 11B. The coupling capacitance electrode 29 extends from a position above the strip line 18 between the first via electrode portion 20A of the resonator 11A and the second via electrode portion 20B of the resonator 11A, to above the strip line 18 of the resonator 11B. Moreover, the coupling capacitance electrode 29 extends from a position above the strip line 18 between the first via electrode portion 20A of the resonator 11C and the second via electrode portion 20B of the resonator 11C, to above the strip line 18 of the resonator 11B.

The capacitor electrode pattern 26A is formed in the same layer as the capacitor electrode pattern 27A. The gap 33A exists between the capacitor electrode pattern 26A and the capacitor electrode pattern 27A. The coupling capacitance electrode 31A that faces the capacitor electrode pattern 27A and the capacitor electrode pattern 26A is formed above the layer where the capacitor electrode pattern 27A and the capacitor electrode pattern 26A are formed. The capacitor electrode pattern 26A is capacitively coupled to the capacitor electrode pattern 27A via the coupling capacitance electrode 31A. Moreover, the capacitor electrode pattern 26A is capacitively coupled to the capacitor electrode pattern 27A via the gap 33A.

The capacitor electrode pattern 26B is formed in the same layer as the capacitor electrode pattern 27B. The gap 33B exists between the capacitor electrode pattern 26B and the capacitor electrode pattern 27B. The coupling capacitance electrode 31B that faces the capacitor electrode pattern 27B and the capacitor electrode pattern 26B is formed above the layer where the capacitor electrode pattern 27B and the capacitor electrode pattern 26B are formed. The capacitor electrode pattern 26B is capacitively coupled to the capacitor electrode pattern 27B via the coupling capacitance electrode 31B. Moreover, the capacitor electrode pattern 26B is capacitively coupled to the capacitor electrode pattern 27B via the gap 33B.

In this way, a configuration may be adopted whereby the capacitor electrode patterns 26A, 26B face the coupling capacitance electrodes 31A, 31B that are formed so as to face the capacitor electrode patterns 27A, 27B.

Modified Example 3

Figure 13A:
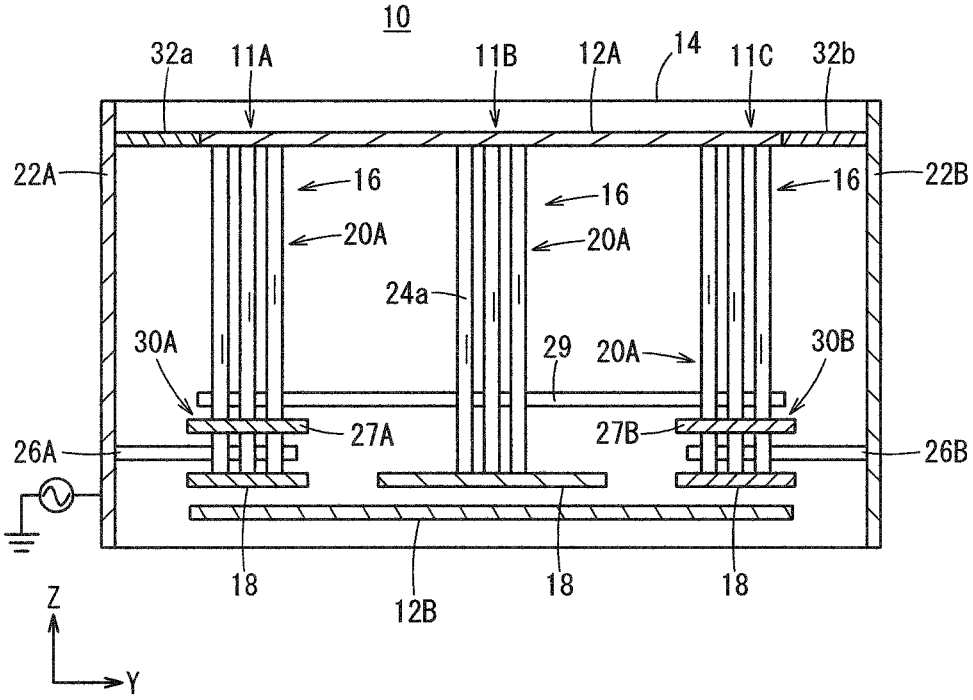
FIGS. 13A and 13B are cross-sectional views showing a filter according to modified example 3 of the first embodiment.
Figure 13B:
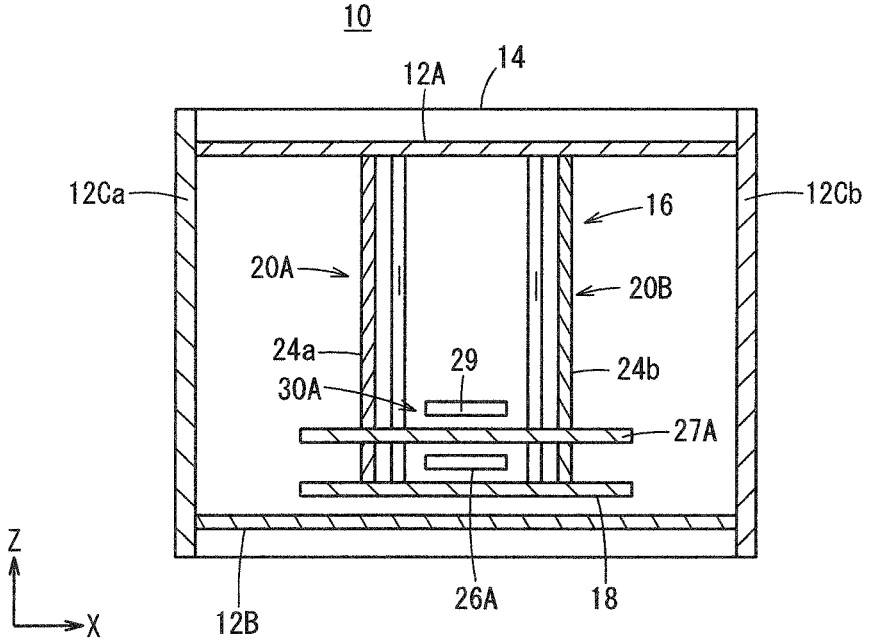

A filter according to modified example 3 of the present embodiment will be described using FIGS. 13A and 13B. FIGS. 13A and 13B are cross-sectional views showing the filter according to the present modified example.

A filter 10 according to the present modified example is one in which the capacitor electrode patterns 26A, 26B are formed so as to face the strip lines 18 of the resonators 11A, 11C.

As shown in FIGS. 13A and 13B, the capacitor electrode pattern 27A is formed so as to face the strip line 18 of the resonator 11A. The capacitor electrode pattern 27A is positioned above the strip line 18 of the resonator 11A. Moreover, the capacitor electrode pattern 27B is formed so as to face the strip line 18 of the resonator 11C. The capacitor electrode pattern 27B is positioned above the strip line 18 of the resonator 11C.

The capacitor electrode patterns 26A, 26B are formed in a layer between the layer where the strip lines 18 are formed and the layer where the capacitor electrode patterns 27A, 27B are formed. The capacitor electrode pattern 26A is formed so as to extend to the first input/output terminal 22A from a position above the strip line 18 between the first via electrode portion 20A of the resonator 11A and the second via electrode portion 20B of the resonator 11A. The capacitor electrode pattern 26B is formed so as to extend to the second input/output terminal 22B from a position above the strip line 18 between the first via electrode portion 20A of the resonator 11C and the second via electrode portion 20B of the resonator 11C.

The coupling capacitance electrode 29 is formed so as to face the strip line 18 of the resonator 11C. The coupling capacitance electrode 29 is formed in a layer further to an upper side than the layer where the capacitor electrode patterns 27A, 27B are formed. The coupling capacitance electrode 29 extends from a position above the capacitor electrode pattern 27A between the first via electrode portion 20A of the resonator 11A and the second via electrode portion 20B of the resonator 11A, to above the strip line 18 of the resonator 11B. Moreover, the coupling capacitance electrode 29 extends from a position above the capacitor electrode pattern 27B between the first via electrode portion 20A of the resonator 11C and the second via electrode portion 20B of the resonator 11C, to above the strip line 18 of the resonator 11B.

In this way, a configuration may be adopted whereby the strip lines 18 of the resonators 11A, 11C are faced by the capacitor electrode patterns 26A, 26B.

Modified Example 4

Figure 14A:
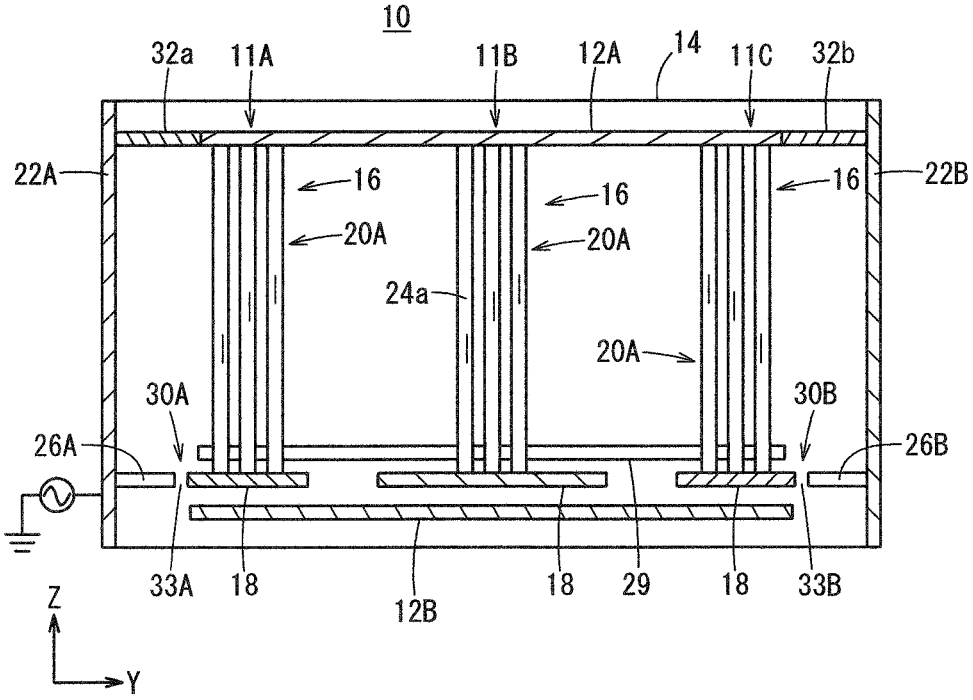
FIGS. 14A and 14B are cross-sectional views showing a filter according to modified example 4 of the first embodiment.
Figure 14B:
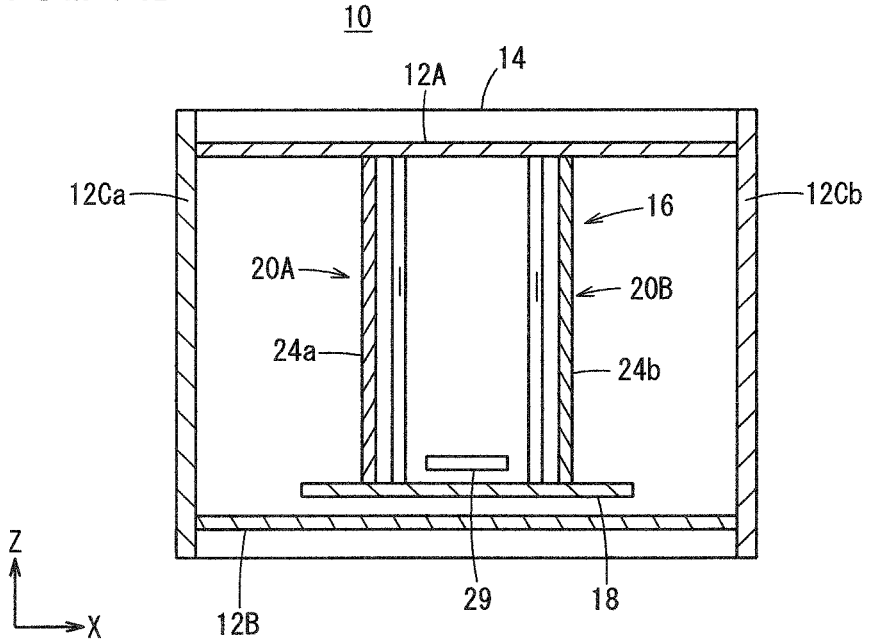
Figure 15:
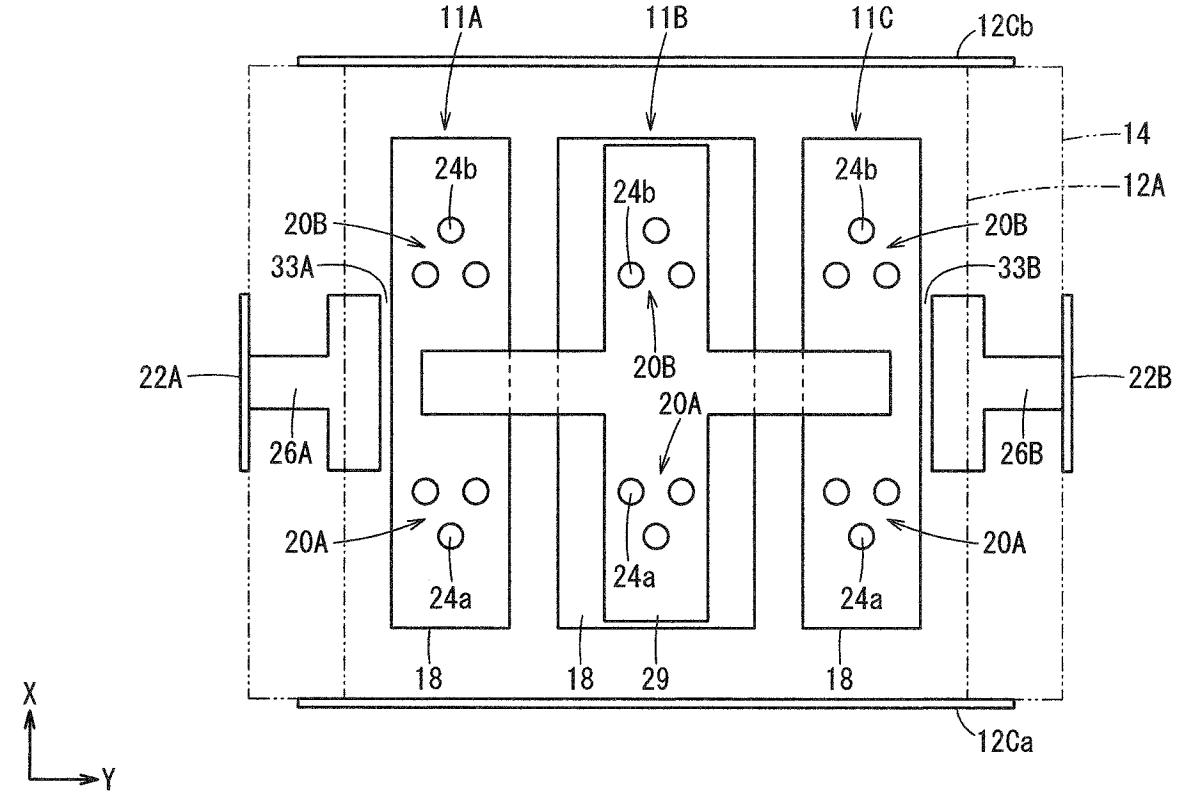
FIG. 15 is a plan view showing the filter according to modified example 4 of the first embodiment.

A filter according to modified example 4 of the present embodiment will be described using FIGS. 14A to 15. FIGS. 14A and 14B are cross-sectional views showing the filter according to the present modified example. FIG. 15 is a plan view showing the filter according to the present modified example.

The present modified example is one in which the capacitor electrode patterns 26A, 26B and the strip lines 18 are formed in the same layer, and the capacitor electrode patterns 26A, 26B are capacitively coupled to the strip lines 18 via the gaps 33A, 33B.

The capacitor electrode pattern 26A is formed in the same layer as the strip lines 18. The gap 33A exists between the capacitor electrode pattern 26A and the strip line 18 of the resonator 11A. The capacitor electrode pattern 26A is capacitively coupled to the strip line 18 of the resonator 11A via the gap 33A.

The capacitor electrode pattern 26B is formed in the same layer as the strip lines 18. The gap 33B exists between the capacitor electrode pattern 26B and the strip line 18 of the resonator 11C. The capacitor electrode pattern 26B is capacitively coupled to the strip line 18 of the resonator 11C via the gap 33B.

The coupling capacitance electrode 29 is formed above the layer where the strip lines 18 are formed. The coupling capacitance electrode 29 is connected to the upper shielding conductor 12A by a portion other than the lower portion of the via electrode portion 20 of the resonator 11B. The coupling capacitance electrode 29 is connected to the strip line 18 of the resonator 11B by the lower portion of the via electrode portion 20 of the resonator 11B. The coupling capacitance electrode 29 extends from a position above the strip line 18 between the first via electrode portion 20A of the resonator 11A and the second via electrode portion 20B of the resonator 11A, to above the strip line 18 of the resonator 11B. Moreover, the coupling capacitance electrode 29 extends from a position above the strip line 18 between the first via electrode portion 20A of the resonator 11C and the second via electrode portion 20B of the resonator 11C, to above the strip line 18 of the resonator 11B. In the present modified example, the capacitor electrode patterns 27A, 27B are not formed.

In this way, the capacitor electrode patterns 26A, 26B and the strip lines 18 may be formed in the same layer. Moreover, a configuration may be adopted whereby the capacitor electrode patterns 26A, 26B are capacitively coupled to the strip lines 18 via the gaps 33A, 33B.

Modified Example 5

Figure 16A:
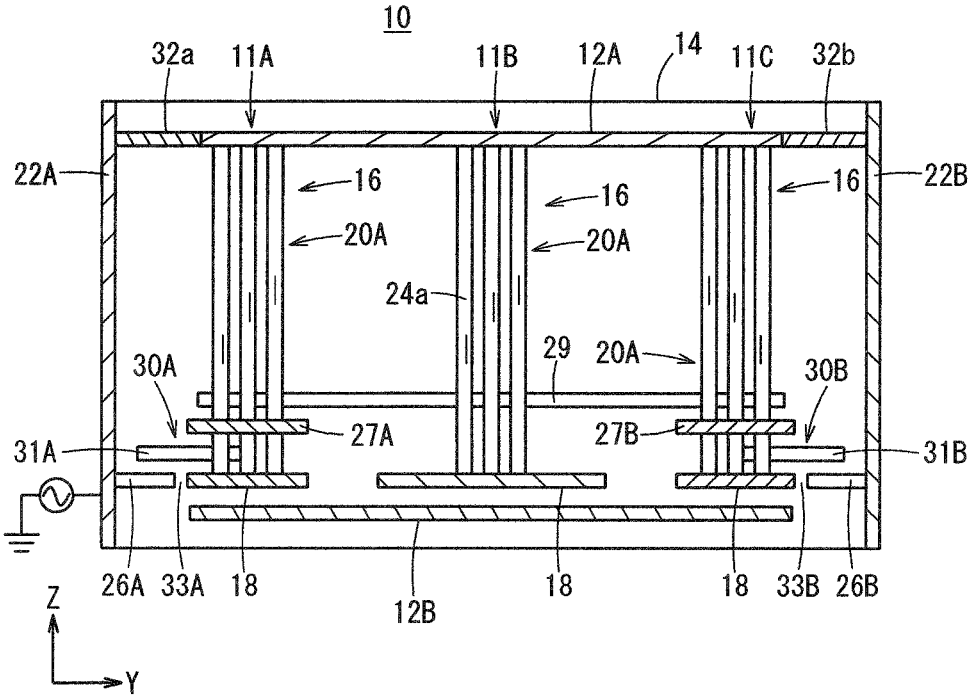
FIGS. 16A and 16B are cross-sectional views showing a filter according to modified example 5 of the first embodiment.
Figure 16B:
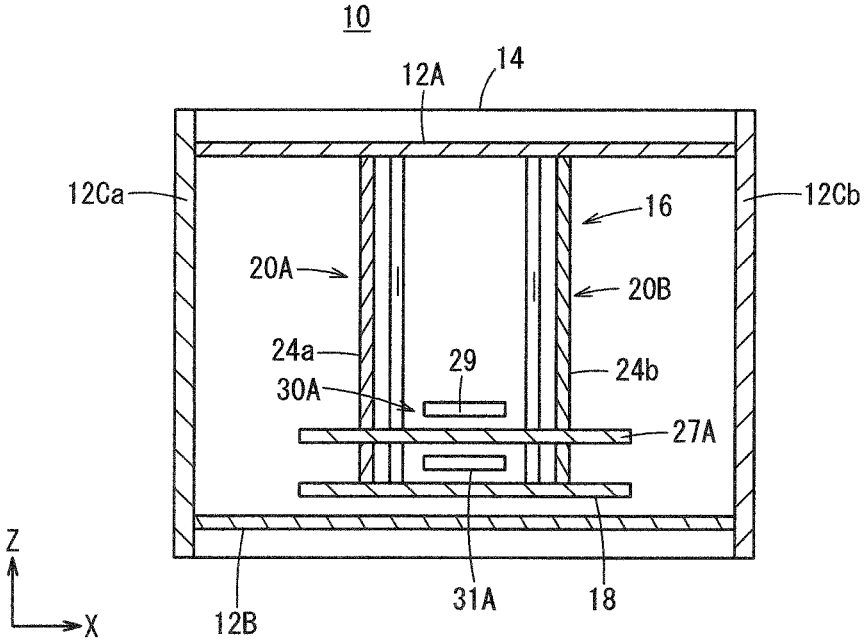
Figure 17:
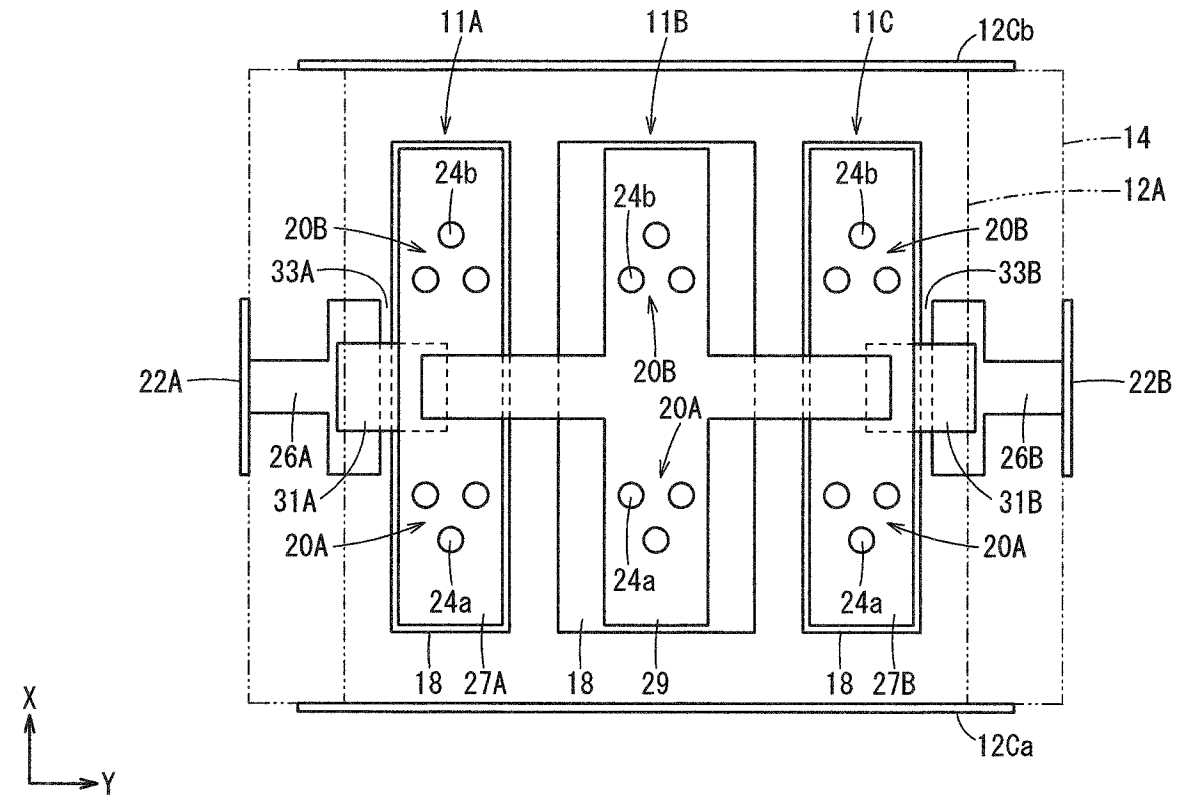
FIG. 17 is a plan view showing the filter according to modified example 5 of the first embodiment.

A filter according to modified example 5 of the present embodiment will be described using FIGS. 16A to 17. FIGS. 16A and 16B are cross-sectional views showing the filter according to the present modified example. FIG. 17 is a plan view showing the filter according to the present modified example.

The present modified example is one in which the capacitor electrode patterns 26A, 26B face the coupling capacitance electrodes 31A, 31B that are formed so as to face the strip lines 18.

The capacitor electrode pattern 26A is formed in the same layer as the strip lines 18. The gap 33A exists between the capacitor electrode pattern 26A and the strip line 18 of the resonator 11A. The coupling capacitance electrode 31A that faces the capacitor electrode pattern 26A and the strip line 18 of the resonator 11A is formed above the layer where the capacitor electrode pattern 26A and the strip lines 18 are formed. The capacitor electrode pattern 26A is capacitively coupled to the strip line 18 of the resonator 11A via the coupling capacitance electrode 31A. Moreover, the capacitor electrode pattern 26A is capacitively coupled to the strip line 18 of the resonator 11A via the gap 33A.

The capacitor electrode pattern 26B is formed in the same layer as the strip lines 18. The gap 33B exists between the capacitor electrode pattern 26B and the strip line 18 of the resonator 11C. The coupling capacitance electrode 31B that faces the capacitor electrode pattern 26B and the strip line 18 of the resonator 11C is formed above the layer where the capacitor electrode pattern 26B and the strip lines 18 are formed. The capacitor electrode pattern 26B is capacitively coupled to the strip line 18 of the resonator 11C via the coupling capacitance electrode 31B. Moreover, the capacitor electrode pattern 26B is capacitively coupled to the strip line 18 of the resonator 11C via the gap 33B.

The capacitor electrode pattern 27A is positioned above the strip line 18 of the resonator 11A. Moreover, the capacitor electrode pattern 27B is positioned above the strip line 18 of the resonator 11C. The capacitor electrode patterns 27A, 27B are positioned in a layer above a layer where the coupling capacitance electrodes 31A, 31B are formed.

The coupling capacitance electrode 29 is formed in a layer above the layer where the capacitor electrode patterns 27A, 27B are formed. The coupling capacitance electrode 29 is connected to the upper shielding conductor 12A by a portion other than the lower portion of the via electrode portion 20 of the resonator 11B. The coupling capacitance electrode 29 is connected to the strip line 18 of the resonator 11B by the lower portion of the via electrode portion 20 of the resonator 11B. The coupling capacitance electrode 29 extends from a position above the capacitor electrode pattern 27A between the first via electrode portion 20A of the resonator 11A and the second via electrode portion 20B of the resonator 11A, to above the strip line 18 of the resonator 11B. Moreover, the coupling capacitance electrode 29 extends from a position above the capacitor electrode pattern 27B between the first via electrode portion 20A of the resonator 11C and the second via electrode portion 20B of the resonator 11C, to above the strip line 18 of the resonator 11B.

In this way, a configuration may be adopted whereby the capacitor electrode patterns 26A, 26B face the coupling capacitance electrodes 31A, 31B that are formed so as to face the strip lines 18.

Modified Example 6

Figure 18:
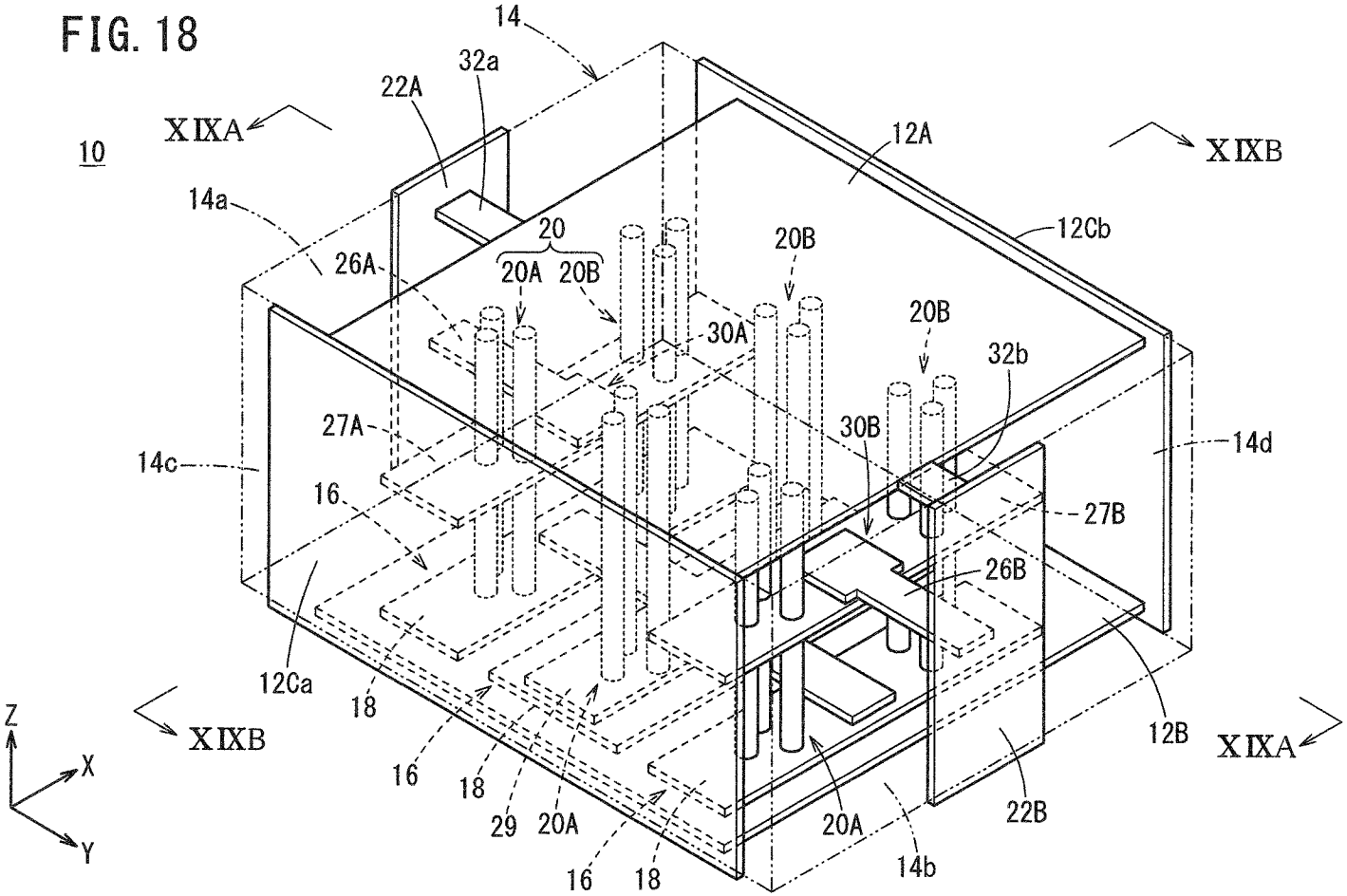
FIG. 18 is a perspective view showing a filter according to modified example 6 of the first embodiment.
Figure 19A:
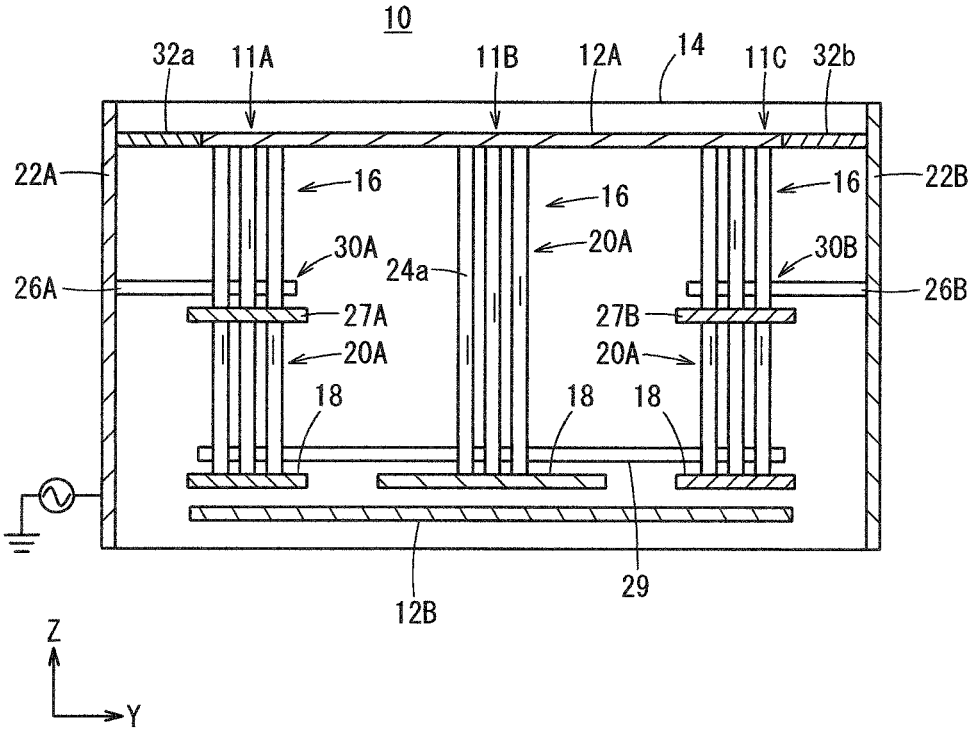
FIGS. 19A and 19B are cross-sectional views showing the filter according to modified example 6 of the first embodiment.
Figure 19B:
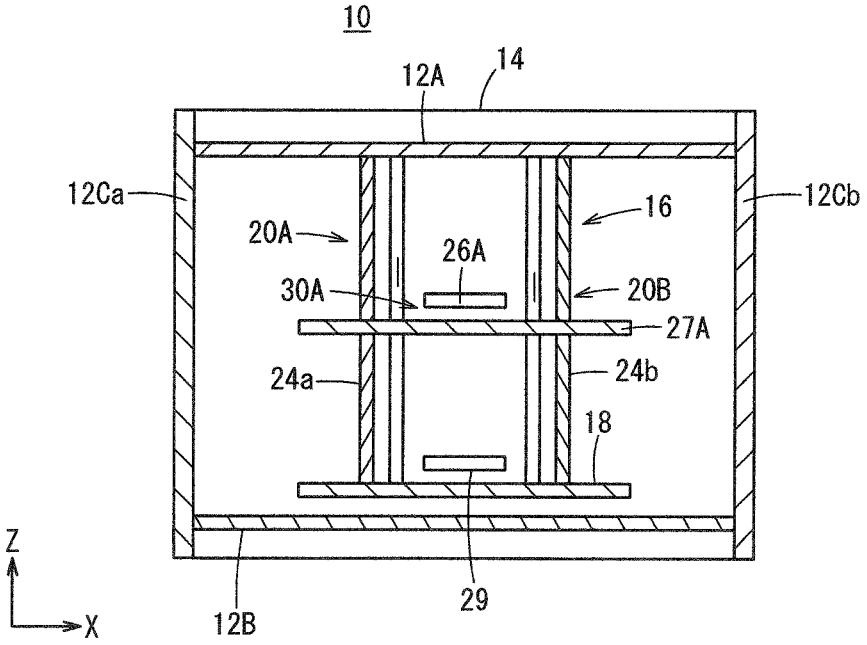

A filter according to modified example 6 of the present embodiment will be described using FIGS. 18 to 19B. FIG. 18 is a perspective view showing the filter according to the present modified example. FIGS. 19A and 19B are cross-sectional views showing the filter according to the present modified example. FIG. 19A corresponds to the line XIXA-XIXA of FIG. 18. FIG. 19B corresponds to the line XIXB-XIXB of FIG. 18.

A filter 10 according to the present modified example is one in which the capacitor electrode patterns 27A, 27B are connected to the via electrode portions 20 in the middle in a longitudinal direction of the via electrode portions 20.

In the present modified example, the capacitor electrode patterns 27A, 27B are connected to the via electrode portions 20 in the middle in the longitudinal direction of the via electrode portions 20. The capacitor electrode pattern 26A faces the capacitor electrode pattern 27A, and the capacitor electrode pattern 26B faces the capacitor electrode pattern 27B. The capacitor electrode pattern 26A, the capacitor electrode pattern 27A, and the dielectric existing between these capacitor electrode patterns 26A and 27A configure the capacitor 30A. The capacitor electrode pattern 26B, the capacitor electrode pattern 27B, and the dielectric existing between these capacitor electrode patterns 26B and 27B configure the capacitor 30B.

In the present modified example too, the capacitor 30A is provided between the first input/output terminal 22A and the resonator 11A, and the capacitor 30B is provided between the second input/output terminal 22B and the resonator 11C. In the present modified example too, these capacitors 30A, 30B enable a desired attenuation pole at a desired frequency position to be formed in a vicinity of a pass band, hence the present modified example too enables a filter 10 having good characteristics to be obtained. Moreover, since input/output impedance can be adjusted by these capacitors 30A, 30B, the present modified example too enables inconsistency of input/output impedance to be suppressed.

Moreover, such capacitors 30A, 30B have a simple configuration. Hence, the present modified example too makes it possible to provide a filter 10 which is small-sized and has good characteristics.

Modified Example 7

Figure 20:
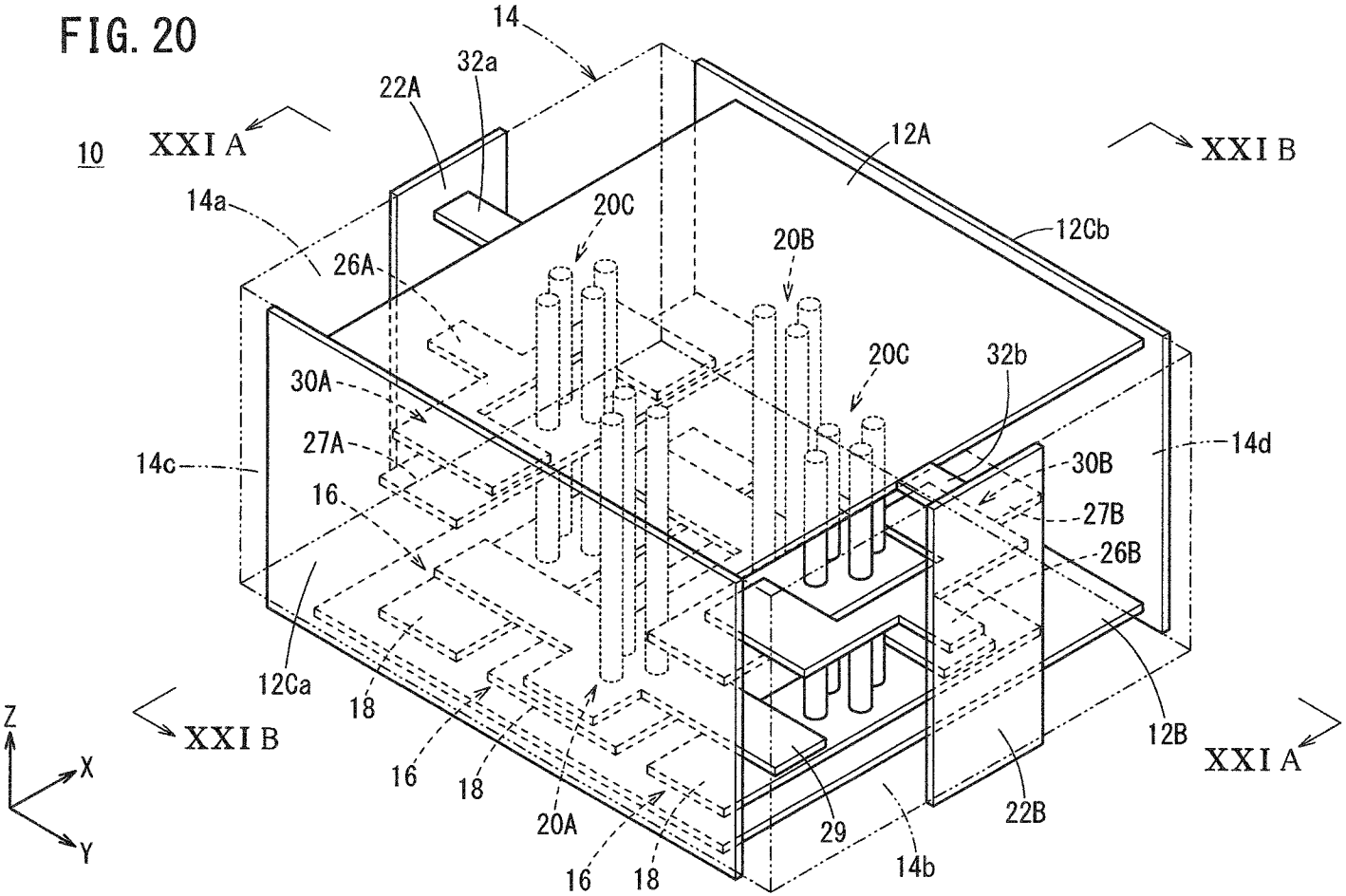
FIG. 20 is a perspective view showing a filter according to modified example 7 of the first embodiment.
Figure 21A:
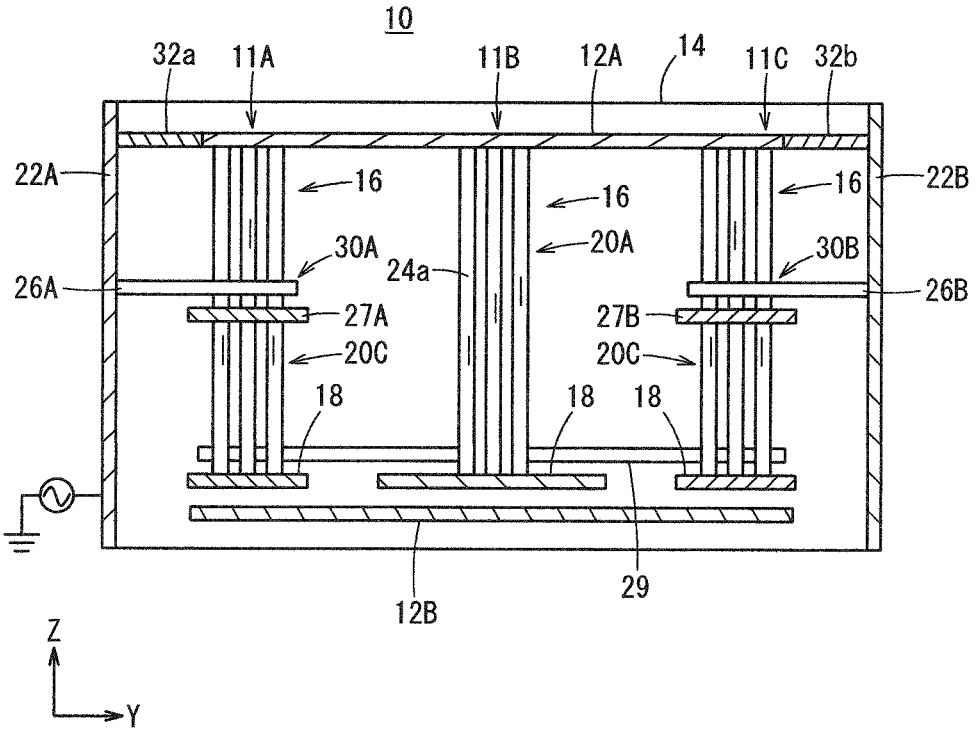
FIGS. 21A and 21B are cross-sectional views showing the filter according to modified example 7 of the first embodiment.
Figure 21B:
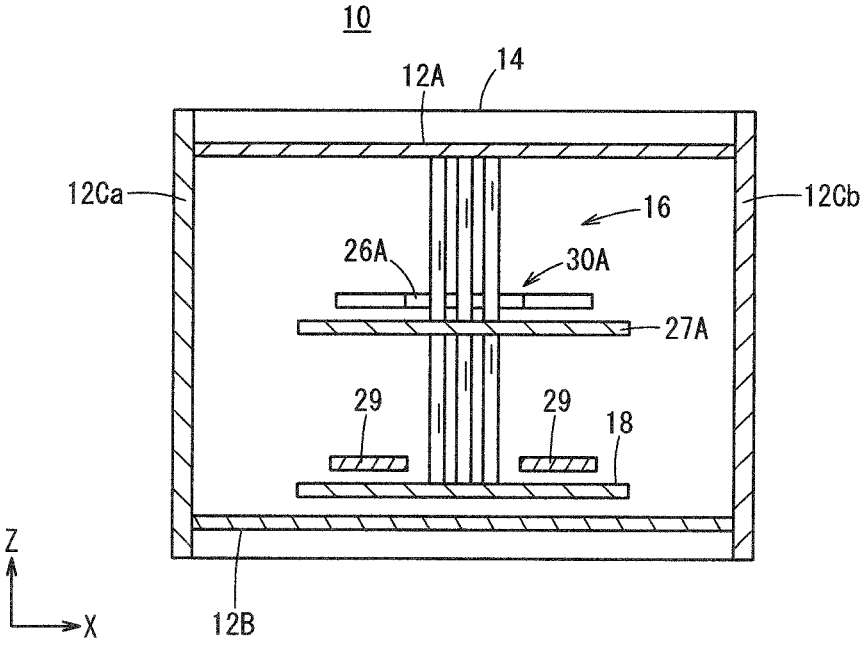
Figure 22:
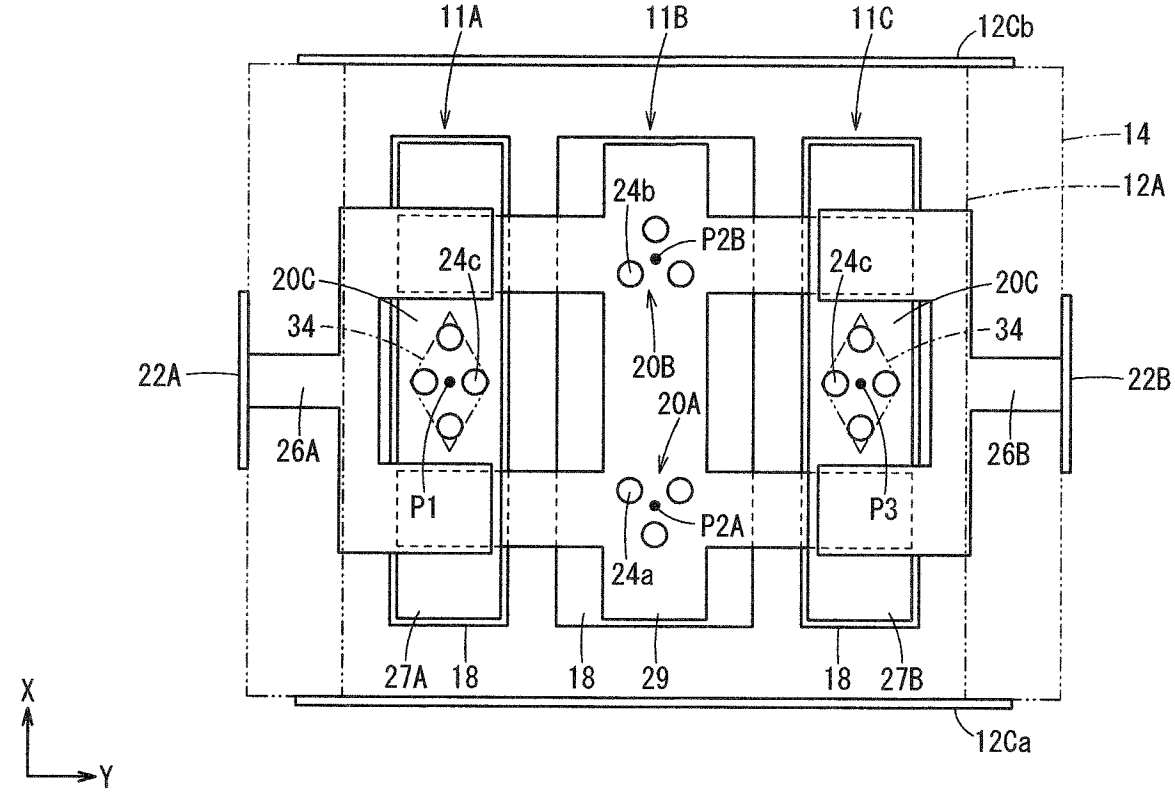
FIG. 22 is a plan view showing the filter according to modified example 7 of the first embodiment.

A filter according to modified example 7 of the present embodiment will be described using FIGS. 20 to 22. FIG. 20 is a perspective view showing the filter according to the present modified example. FIGS. 21A and 21B are cross-sectional views showing the filter according to the present modified example. FIG. 21A corresponds to the line XXIA-XXIA of FIG. 20. FIG. 21B corresponds to the line XXIB-XXIB of FIG. 20. FIG. 22 is a plan view showing the filter according to the present modified example.

In the present modified example, the resonator 11A is provided with one via electrode portion (a third via electrode portion) 20C. The third via electrode portion 20C of the resonator 11A is configured from a plurality of via electrodes (third via electrodes) 24*c* (refer to FIG. 22). The third via electrodes 24*c* are embedded in via holes formed in the dielectric substrate 14. The one third via electrode portion 20C is configured by four third via electrodes 24*c*, for example. The four third via electrodes 24*c* configuring the one third via electrode portion 20C are positioned at vertices of an imaginary rhombus 34. The third via electrode portion 20C of the resonator 11A is connected to the strip line 18 of the resonator 11A at a center in an X direction of the strip line 18. Note that a direction normal to the third side surface 14*c* and the fourth side surface 14*d* is assumed to be the X direction (a first direction). A direction normal to the first side surface 14*a* and the second side surface 14*b* is assumed to be a Y direction (a second direction). Moreover, a direction normal to the one principal surface and the other principal surface of the dielectric substrate 14 is assumed to be a Z direction.

The resonator 11B is provided with two via electrode portions, that is, the first via electrode portion 20A and the second via electrode portion 20B. The first via electrode portion 20A of the resonator 11B is positioned on a third side surface 14*c* side of the dielectric substrate 14. The second via electrode portion 20B of the resonator 11B is positioned on a fourth side surface 14*d* side of the dielectric substrate 14.

The resonator 11C is provided with one via electrode portion (the third via electrode portion) 20C. The third via electrode portion 20C of the resonator 11C is connected to the strip line 18 of the resonator 11C at a center in the X direction of the strip line 18. Note that although there has been described here as an example the case where one third via electrode portion 20C is configured by four third via electrodes 24*c*, the present modified example is not limited to this.

Positions P2A, P2B of the via electrode portions 20A, 20B of the resonator 11B, and a position P1 of the via electrode portion 20C of the resonator 11A differ in the X direction. A position P3 of the via electrode portion 20C of the resonator 11C, and the positions P2A, P2B of the via electrode portions 20A, 20B of the resonator 11B differ in the X direction. Note that description will be made here assuming a position of a center of the via electrode portion 20C of the resonator 11A to be the position P1 of the via electrode portion 20C. Moreover, description will be made here assuming positions of centers of the via electrode portions 20A, 20B of the resonator 11B to be the positions P2A, P2B of the via electrode portions 20A, 20B. Moreover, description will be made here assuming a position of a center of the via electrode portion 20C of the resonator 11C to be the position P3 of the via electrode portion 20C. A position of the via electrode portion 20C of the resonator 11A, that is, the position P1 is at a center of the strip line 18 of the resonator 11A. A position of a center of the via electrode portion 20C of the resonator 11C, that is, the position P3 is at a center of the strip line 18 of the resonator 11C.

In the present modified example, the capacitor electrode pattern 26A extends to the first input/output terminal 22A from positions above the capacitor electrode pattern 27A on both sides of the via electrode portion 20C of the resonator 11A. Moreover, in the present modified example, the capacitor electrode pattern 26B extends to the second input/output terminal 22B from positions above the capacitor electrode pattern 27B on both sides of the via electrode portion 20C of the resonator 11C.

In the present modified example, the coupling capacitance electrode 29 extends to a position above the strip line 18 of the resonator 11B from positions above the strip line 18 on both sides of the via electrode portion 20C of the resonator 11A. Moreover, in the present modified example, the coupling capacitance electrode 29 extends to a position above the strip line 18 of the resonator 11B from positions above the strip line 18 on both sides of the via electrode portion 20C of the resonator 11C.

Thus, in the present modified example, positions of the via electrode portions 20A, 20B and positions of the via electrode portions 200 are offset from each other in the X direction, among the mutually adjacent resonators 11A to 11C. Therefore, due to the present modified example, a distance between the via electrode portions 20A, 20B and the via electrode portions 20C can be increased, without a distance in the Y direction between the mutually adjacent resonators 11A to 11C being increased. Therefore, due to the present modified example, a degree of coupling between the mutually adjacent resonators 11A to 11C can be reduced, without the distance in the Y direction between the mutually adjacent resonators 11A to 11C being increased. Hence, due to the present modified example, the degree of coupling between the mutually adjacent resonators 11A to 11C can be reduced while size of the filter 10 is kept small. Since the distance between the via electrode portions 20A, 20B and the via electrode portions 20C of the mutually adjacent resonators 11A to 11C can be increased, a high Q-factor can be obtained.

Modified Example 8

Figure 23A:
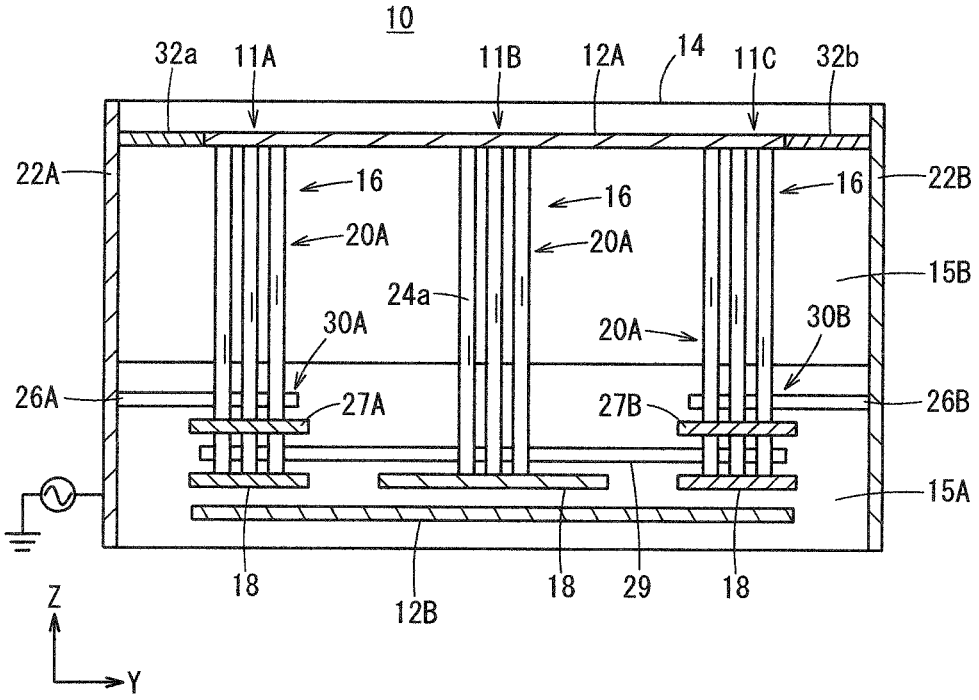
FIGS. 23A and 23B are cross-sectional views showing a filter according to modified example 8 of the first embodiment.
Figure 23B:
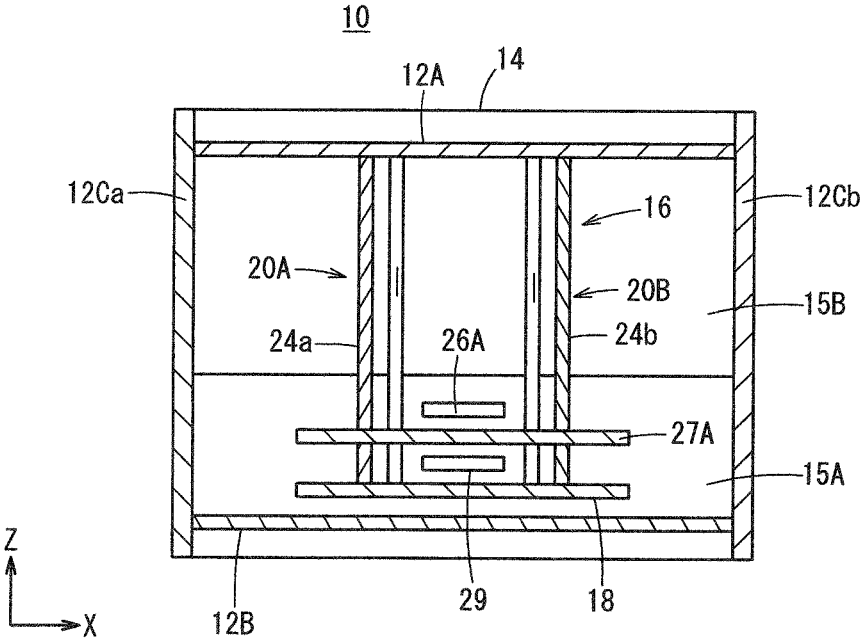

A filter according to modified example 8 of the present embodiment will be described using FIGS. 23A and 23B. FIGS. 23A and 23B are cross-sectional views showing the filter according to the present modified example.

In the present modified example, the dielectric substrate 14 is configured by dielectric layers whose relative dielectric constants differ. In the present modified example, the capacitor electrode patterns 26A, 26B, 27A, 27B, the coupling capacitance electrode 29, and the strip lines 18 are embedded in a dielectric layer whose relative dielectric constant is comparatively low.

As shown in FIGS. 23A and 23B, in the present modified example, the dielectric substrate 14 is configured by: a dielectric layer (a first dielectric layer) 15A whose relative dielectric constant is comparatively low; and a dielectric layer (a second dielectric layer) 15B whose relative dielectric constant is comparatively high. On one principal surface side being a side where the dielectric layer 15B is positioned, of the dielectric substrate 14, that is, on an upper side of the dielectric substrate 14 in FIGS. 23A and 23B, there is positioned the upper shielding conductor 12A. On the other principal surface side being a side where the dielectric layer 15A is positioned, of the dielectric substrate 14, that is, on a lower side of the dielectric substrate 14 in FIGS. 23A and 23B, there is positioned the lower shielding conductor 128. A thickness of the dielectric layer 15A may be set to about 200 μm to 300 μm, for example, but is not limited to this. A thickness of the dielectric substrate 14 may be set to about 1.5 mm to 2.0 mm, for example, but is not limited to this.

The strip lines 18, the capacitor electrode patterns 26A, 26B, 27A, 27B, and the coupling capacitance electrode 29 are embedded in the dielectric layer 15A whose relative dielectric constant is comparatively low. The via electrode portions 20 are embedded at least in the dielectric layer 15B whose relative dielectric constant is comparatively high. The via electrode portions 20 are connected to the strip lines 18 within the dielectric layer 15A.

In the present modified example, parts of the dielectric layer 15A whose relative dielectric constant is comparatively low are sandwiched between the capacitor electrode patterns 26A, 26B and the capacitor electrode patterns 27A, 27B. Therefore, in the present modified example, even if distance between the capacitor electrode patterns 26A, 26B and the capacitor electrode patterns 27A, 27B varies to a certain extent, variation in electrostatic capacitance of the capacitors 30A, 30B manages to be small. Moreover, even if line width of the capacitor electrode patterns 26A, 26B, 27A, 27B varies to a certain extent, change in electrostatic capacitance of the capacitors 30A, 30B manages to be small. In addition, in the present modified example, parts of the dielectric layer 15A whose relative dielectric constant is comparatively low are sandwiched between the capacitor electrode patterns 27A, 27B and the coupling capacitance electrode 29. Therefore, in the present modified example, even if distance between the capacitor electrode patterns 27A, 27B and the coupling capacitance electrode 29 varies to a certain extent, variation in electrostatic capacitance between these capacitor electrode patterns 27A, 27B and coupling capacitance electrode 29 manages to be small. Moreover, even if line width of the capacitor electrode patterns 27A, 27B or the coupling capacitance electrode 29 varies to a certain extent, change in electrostatic capacitance of the capacitors 30A, 30B manages to be small. In addition, in the present modified example, parts of the dielectric layer 15A whose relative dielectric constant is comparatively low are sandwiched between the strip lines 18 and the coupling capacitance electrode 29. Therefore, in the present modified example, even if distance between the strip lines 18 and the coupling capacitance electrode 29 varies to a certain extent, variation in electrostatic capacitance between these strip lines 18 and coupling capacitance electrode 29 manages to be small. Moreover, even if line width of the strip lines 18 or the coupling capacitance electrode 29 varies to a certain extent, variation in electrostatic capacitance between these strip lines 18 and coupling capacitance electrode 29 manages to be small. Therefore, due to the present modified example, variation in filter characteristics can be reduced.

In the resonators 11A to 11C having a structure like that of the present embodiment, resonance frequency is substantially determined by length of the via electrode portion 20 and electrostatic capacitance between the strip lines 18 and the lower shielding conductor 12B. The resonance frequency tends to lower as the length of the via electrode portion 20 becomes longer. In the case of resonance frequencies being the same, Q-factor will be higher for the resonators 11A to 11C in which length of the via electrode portion 20 is longer. Moreover, the resonance frequency tends to lower as electrostatic capacitance between the strip lines 18 and the lower shielding conductor 12B becomes larger. In the case where a dielectric layer whose relative dielectric constant is comparatively high has been caused to exist between the strip lines 18 and the lower shielding conductor 12B, electrostatic capacitance between the strip lines 18 and the lower shielding conductor 12B increases. In the case of the electrostatic capacitance between the strip lines 18 and the lower shielding conductor 12B having increased, it is conceivable that, in order for a desired resonance frequency to be obtained, length of the via electrode portion 20 is shortened, for example. However, if length of the via electrode portion 20 is shortened, then the Q-factor ends up lowering. It is conceivable too that, in order to prevent increase in the electrostatic capacitance between the strip lines 18 and the lower shielding conductor 12B, area of the strip lines 18 is made smaller. However, if area of the strip lines 18 is made smaller, then sometimes, a limitation will occur in layout of patterns of the coupling capacitance electrode 29, and so on, provided between the resonators 11A to 11C.

Moreover, in the case where pluralities of the via electrodes 24*a*, 24*b* are used to configure the resonators 11A to 11C, strip lines 18 of sufficiently large area are required, and in such a case, it is difficult for area of the strip lines 18 to be made smaller. In contrast, in the present modified example, the dielectric layer 15A whose relative dielectric constant is comparatively low exists between the strip lines 18 and the lower shielding conductor 12B, hence the above-described kinds of problems can be avoided.

In the present modified example, the via electrode portions 20 are embedded in the dielectric layer 15B whose relative dielectric constant is comparatively high. Therefore, in the present modified example, a wavelength shortening effect may be obtained in the portions. Therefore, due to the present modified example, a transmission line can be shortened, and a contribution can be made to downsizing of the filter 10.

Modified Example 9

Figure 24A:
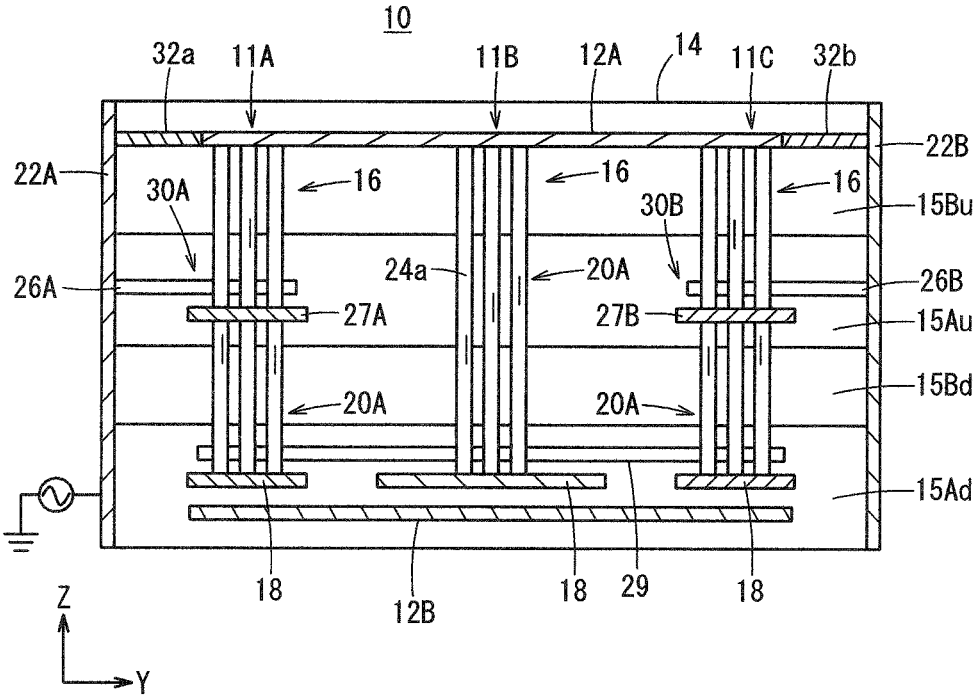
FIGS. 24A and 24B are cross-sectional views showing a filter according to modified example 9 of the first embodiment.
Figure 24B:
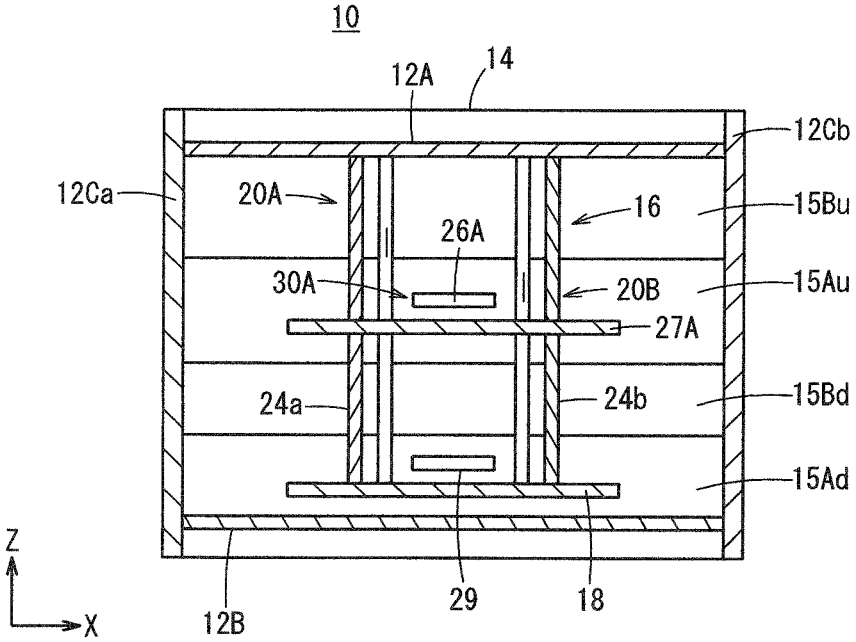

A filter according to modified example 9 of the present embodiment will be described using FIGS. 24A and 24B. FIGS. 24A and 24B are cross-sectional views showing the filter according to the present modified example.

In a filter 10 according to the present modified example, the dielectric substrate 14 is configured by dielectric layers whose relative dielectric constants differ. In the present modified example, parts of a dielectric layer whose relative dielectric constant is comparatively low are sandwiched between the capacitor electrode patterns 26A, 26B and the capacitor electrode patterns 27A, 27B.

As shown in FIGS. 24A and 24B, in the present modified example, the dielectric substrate 14 is configured by: dielectric layers 15Ad, 15Au whose relative dielectric constants are comparatively low; and dielectric layers 15Bd, 15Bu whose relative dielectric constants are comparatively high. The dielectric layer 15Bd is laminated on the dielectric layer 15Ad, the dielectric layer 15Au is laminated on the dielectric layer 15Bd, and the dielectric layer 15Bu is laminated on the dielectric layer 15Au. On one principal surface side being a side where the dielectric layer 15Bu is positioned, of the dielectric substrate 14, that is, on an upper side of the dielectric substrate 14 in FIGS. 24A and 24B, there is positioned the upper shielding conductor 12A. On the other principal surface side being a side where the dielectric layer 15Ad is positioned, of the dielectric substrate 14, that is, on a lower side of the dielectric substrate 14 in FIGS. 24A and 24B, there is positioned the lower shielding conductor 12B.

In the present modified example, the capacitor electrode patterns 27A, 27B connected to the via electrode portions 20 are formed within the dielectric substrate 14, similarly to the filter 10 described above using FIGS. 18 to 19B. The capacitor electrode patterns 26A, 26B and the capacitor electrode patterns 27A, 27B are embedded in the dielectric layer 15Au whose relative dielectric constant is comparatively low. The strip lines 18 are embedded in the dielectric layer 15Ad whose relative dielectric constant is comparatively low. The via electrode portions 20 are connected to the strip lines 18 within the dielectric layer 15Ad. The via electrode portions 20 are connected to the capacitor electrode patterns 27A, 27B within the dielectric layer 15Au.

In the present modified example, parts of the dielectric layer 15Au whose relative dielectric constant is comparatively low are sandwiched between the capacitor electrode patterns 26A, 26B and the capacitor electrode patterns 27A, 27B. Therefore, in the present modified example, even if distance between the capacitor electrode patterns 26A, 26B and the capacitor electrode patterns 27A, 27B varies to a certain extent, variation in electrostatic capacitance of the capacitors 30A, 30B manages to be small. Moreover, in the present modified example, even if line width of the capacitor electrode patterns 26A, 26B or the capacitor electrode patterns 27A, 27B varies to a certain extent, variation in electrostatic capacitance of the capacitors 30A, 30B manages to be small. In addition, in the present modified example, parts of the dielectric layer 15Ad whose relative dielectric constant is comparatively low are sandwiched between the strip lines 18 and the coupling capacitance electrode 29. Therefore, in the present modified example, even if distance between the strip lines 18 and the coupling capacitance electrode 29 varies to a certain extent, variation in electrostatic capacitance between these strip lines 18 and coupling capacitance electrode 29 manages to be small. Moreover, even if line width of the strip lines 18 or the coupling capacitance electrode 29 varies to a certain extent, variation in electrostatic capacitance between these strip lines 18 and coupling capacitance electrode 29 manages to be small. Therefore, due to the present modified example, variation in filter characteristics can be reduced.

In the present modified example too, similarly to the case of modified example 8 shown in FIGS. 23A and 23B, parts of the dielectric layer 15Ad whose relative dielectric constant is comparatively low are sandwiched between the strip lines 18 and the lower shielding conductor 12B. Therefore, in the present modified example too, area of the strip lines 18 can be secured in large measure. Therefore, degree of freedom of layout of patterns of the coupling capacitance electrode 29, and so on, provided between the resonators 11A to 11C can be enhanced. Moreover, since area of the strip lines 18 is secured in large measure, resonators 11A to 11C using pluralities of the via electrodes 24*a*, 24*b* can be realized. Therefore, due to the present modified example, resonators 11A to 11C that are good and have a high Q-factor can be obtained.

In the present modified example too, similarly to the case of modified example 8 shown in FIGS. 23A and 23B, the via electrode portions 20 are embedded in the dielectric layers 15Bd, 15Bu whose relative dielectric constants are comparatively high. Therefore, in the present modified example, a wavelength shortening effect may be obtained in the portions. Therefore, in the present modified example too, a transmission line can be shortened, and a contribution can be made to downsizing of the filter 10.

Second Embodiment

Figure 25A:
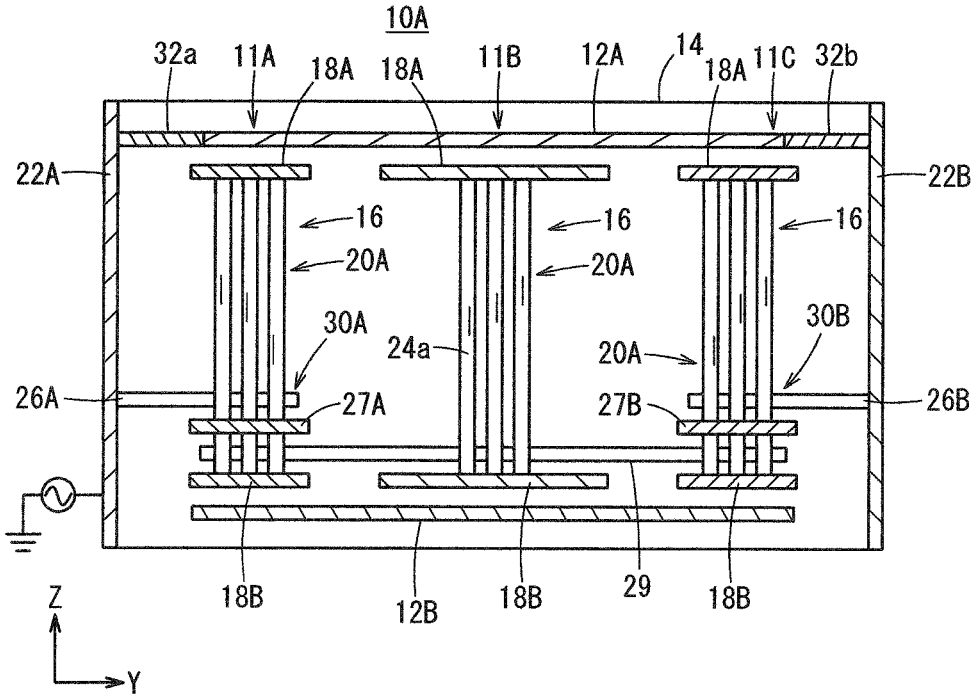
FIGS. 25A and 25B are cross-sectional views showing a filter according to a second embodiment.
Figure 25B:
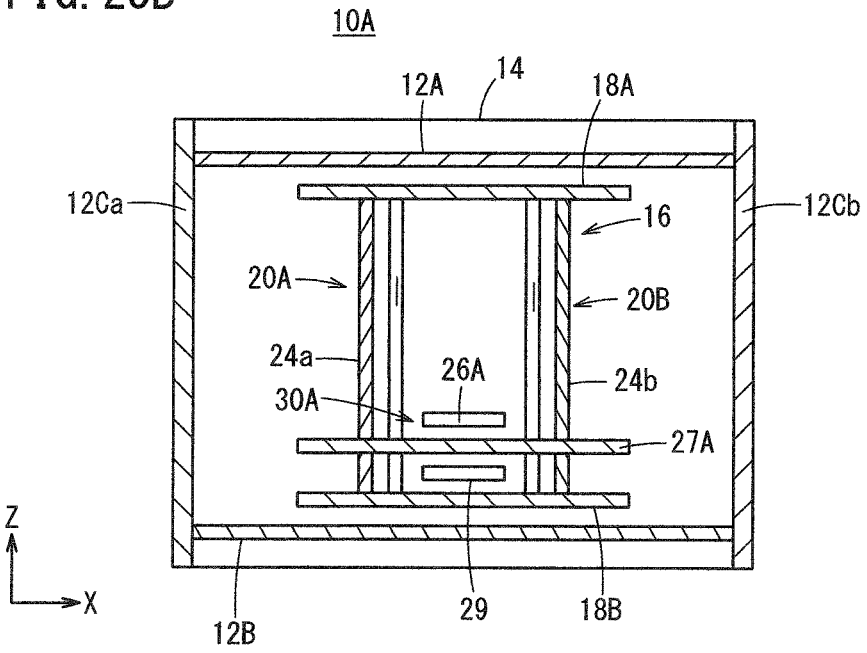

A filter according to a second embodiment will be described using the drawings. FIGS. 25A and 25B are cross-sectional views showing the filter according to the present embodiment. Configuring elements similar to in the filter according to the first embodiment will be assigned with the same symbols as in the first embodiment, and descriptions thereof will be omitted or simplified.

In a filter 10A according to the present embodiment, the dielectric substrate 14 has formed therein: an upper strip line (a second strip line) 18A that faces the upper shielding conductor 12A; and a lower strip line (a first strip line) 18B that faces the lower shielding conductor 12B.

In the present embodiment, one end of the via electrode portion 20 is connected to the upper strip line 18A, and the other end of the via electrode portion 20 is connected to the lower strip line 18B. Thus, the via electrode portion 20 is formed from the upper strip line 18A to the lower strip line 18B. The via electrode portion 20, the upper strip line 18A, and the lower strip line 18B configure the structure 16.

In the present embodiment too, similarly to the filter 10 according to the first embodiment described above using FIGS. 1 to 2B, the capacitor electrode patterns 26A, 26B are formed within the dielectric substrate 14. In the present embodiment too, similarly to the filter 10 according to the first embodiment described above using FIGS. 1 to 2B, the capacitor electrode patterns 27A, 27B that are connected to the via electrode portions 20 are formed within the dielectric substrate 14.

Part of the capacitor electrode pattern 26A faces part of the capacitor electrode pattern 27A, similarly to the filter 10 according to the first embodiment described above using FIGS. 1 to 2B. Part of the capacitor electrode pattern 26B faces part of the capacitor electrode pattern 27B, similarly to the filter 10 according to the first embodiment described above using FIGS. 1 to 2B. The capacitor electrode pattern 26A extends to the first input/output terminal 22A from a position above the capacitor electrode pattern 27A between the first via electrode portion 20A and the second via electrode portion 20B, similarly to the filter 10 according to the first embodiment described above using FIGS. 1 to 2B. The capacitor electrode pattern 26B extends to the second input/output terminal 22B from a position above the capacitor electrode pattern 27B between the first via electrode portion 20A and the second via electrode portion 20B, similarly to the filter 10 according to the first embodiment described above using FIGS. 1 to 2B. The capacitor electrode pattern 26A, the capacitor electrode pattern 27A, and a dielectric existing therebetween configure the capacitor 30A. The capacitor electrode pattern 26B, the capacitor electrode pattern 27B, and a dielectric existing therebetween configure the capacitor 30B.

The via electrode portion 20 and the first side surface shielding conductor 12Ca and second side surface shielding conductor 12Cb behave like a semi-coaxial resonator, similarly to the case of the filter 10 according to the first embodiment.

In the present embodiment, the via electrode portion 20 is not electrically continuous with either the upper shielding conductor 12A or the lower shielding conductor 12B. Electrostatic capacitance (open end capacitance) exists between the upper strip line 18A connected to the via electrode portion 20, and the upper shielding conductor 12A. Moreover, electrostatic capacitance exists also between the lower strip line 18B connected to the via electrode portion 20, and the lower shielding conductor 12B. The via electrode portion 20 configures a $\lambda/2$ resonator in conjunction with the upper strip line 18A and the lower strip line 18B.

In a $\lambda/4$ resonator like that of the first embodiment, current concentrates in a portion where a via electrode portion and a shielding conductor are contacting each other, that is, a short-circuit portion, during resonance. A portion where a via electrode portion and a shielding conductor are contacting each other is a portion where a path of the current bends perpendicularly. Concentration of current in a place where the path of the current bends greatly may cause a lowering of the Q-factor. In order to eliminate concentration of current in a short-circuit portion and thereby improve the Q-factor, it is conceivable too for cross-sectional area of the current path to be made larger. For example, it is conceivable for a via diameter to be made larger or for the number of vias to be increased. However, in the case of doing so, size of the filter ends up increasing, and a requirement of downsizing of the filter cannot be fulfilled. In contrast, in the present embodiment, the via electrode portion 20 does not contact either the upper shielding conductor 12A or the lower shielding conductor 12B. That is, in the present embodiment, a both end-opened type $\lambda/2$ resonator is configured. Therefore, in the present embodiment, a local concentration of current is prevented from occurring in the upper shielding conductor 12A and the lower shielding conductor 12B, and meanwhile, current can be concentrated in a vicinity of a center of the via electrode portion 20. Since it is the via electrode portion 20 alone where current concentrates, that is, since current concentrates where there is continuity (linearity), the present embodiment enables the Q-factor to be improved.

Figure 26:
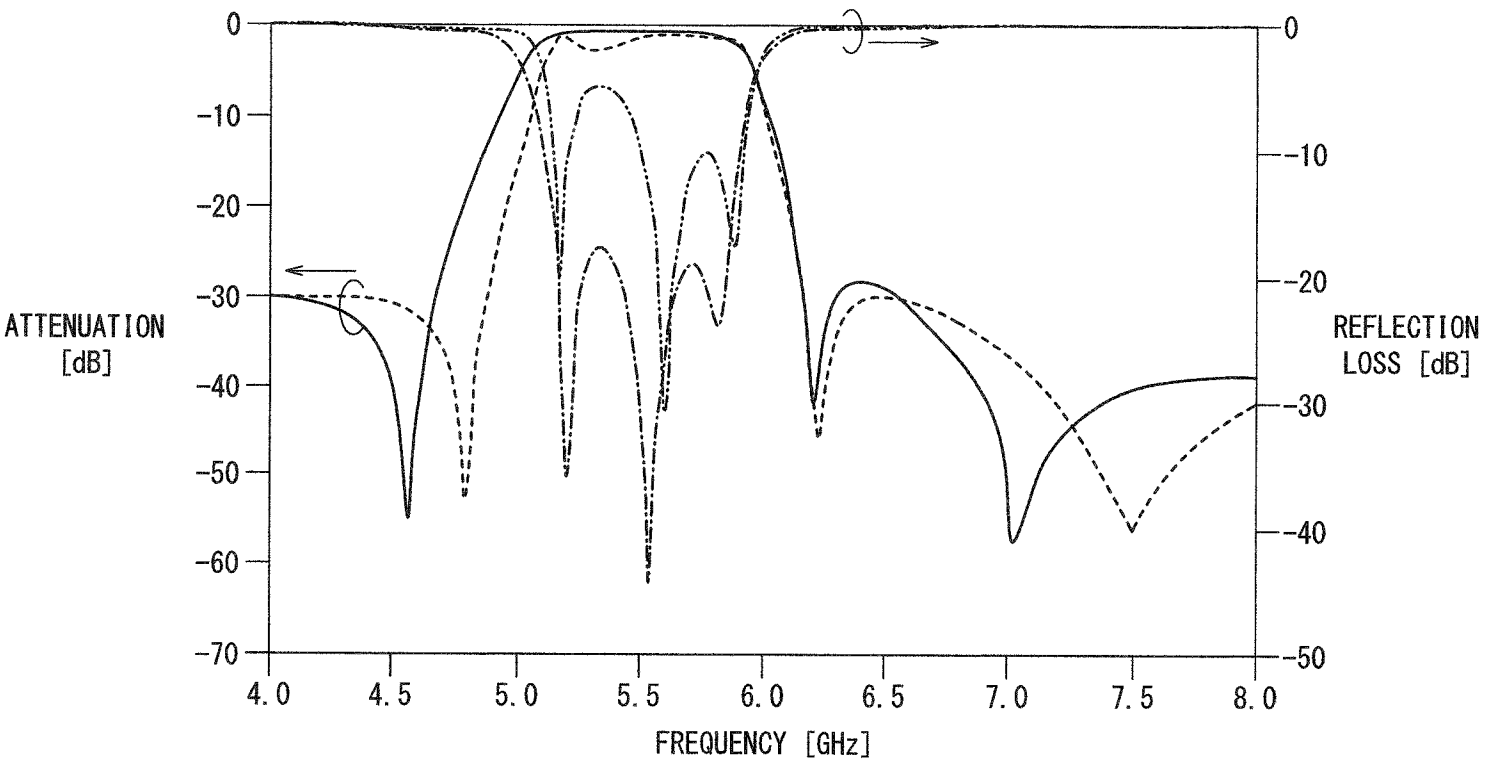
FIG. 26 is a graph showing an example of attenuation characteristics and reflection loss characteristics of the filter according to the second embodiment.
Figure 27:
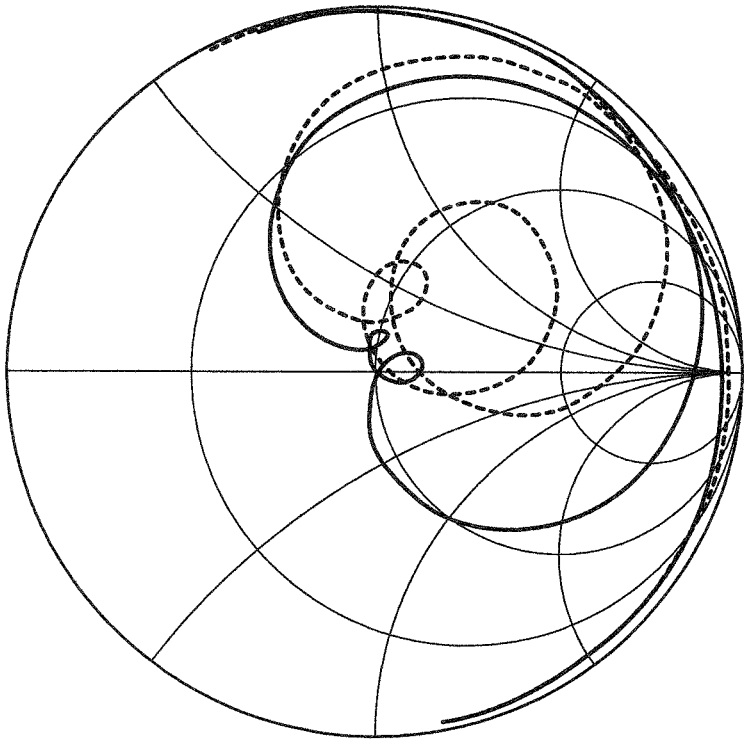
FIG. 27 is a Smith chart showing an example of an input reflection coefficient of the filter according to the second embodiment.

FIG. 26 is a graph showing an example of attenuation characteristics and reflection loss characteristics of the filter according to the present embodiment. The horizontal axis of FIG. 26 indicates frequency, the vertical axis on the left side of FIG. 26 indicates attenuation, and the vertical axis on the right side of FIG. 26 indicates reflection loss. The solid line indicates an example of attenuation in the case of the present embodiment, that is, the case where the capacitors 30A, 30B are provided. The broken line indicates an example of attenuation in the case of reference example 2, that is, the case where the capacitors 30A, 30B are not provided. The one-dot chain line indicates an example of reflection loss in the case of the present embodiment, that is, the case where the capacitors 30A, 30B are provided. The two-dot chain line indicates an example of reflection loss in the case of reference example 2, that is, the case where the capacitors 30A, 30B are not provided. FIG. 27 is a Smith chart showing an example of an input reflection coefficient of the filter according to the present embodiment. FIG. 27 shows an input reflection coefficient (S11) in a frequency range of 4 GHz to 7 GHz. The solid line in FIG. 27 indicates an example of the case where the capacitors 30A, 30B are provided. The broken line in FIG. 27 indicates an example of the case where the capacitors 30A, 30B are not provided. As may be understood from the reflection loss in the range of, for example, 5.2 GHz to 5.5 GHz in FIG. 26, reflection characteristics in the pass band of the filter are improved more in the case of the capacitors 30A, 30B being provided, compared to the case of the capacitors 30A, 30B not being provided. Thus, due to the present embodiment being provided with the capacitors 30A, 30B, the present embodiment too enables inconsistency of the input/output impedance of the filter 10A to be suppressed, and reflection characteristics in the pass band of the filter 10A to be improved.

Thus, in the present embodiment too, the capacitor 30A is provided between the first input/output terminal 22A and the resonator 11A, and the capacitor 30B is provided between the second input/output terminal 22B and the resonator 11C. These capacitors 30A, 30B enable a desired attenuation pole at a desired frequency position in a vicinity of a pass band to be formed, hence the present embodiment too enables a filter 10A having good characteristics to be obtained. Moreover, since input/output impedance can be adjusted by these capacitors 30A, 30B, the present embodiment too enables inconsistency of input/output impedance to be suppressed. Moreover, such capacitors 30A, 30B have a simple configuration. Hence, the present embodiment too makes it possible to provide a filter 10A which is small-sized and has good characteristics. Moreover, in the present embodiment, one end of the via electrode portion 20 is connected to the upper strip line 18A that faces the upper shielding conductor 12A, and the other end of the via electrode portion 20 is connected to the lower strip line 18B that faces the lower shielding conductor 12B. Therefore, in the present embodiment, a local concentration of current is prevented from occurring in the upper shielding conductor 12A and the lower shielding conductor 12B, and meanwhile, current can be concentrated in the vicinity of the center of the via electrode portion 20. Since it is the via electrode portion 20 alone where current concentrates, that is, since current concentrates where there is continuity (linearity), the present embodiment enables the Q-factor to be improved.

Modified Example 1

Figure 28A:
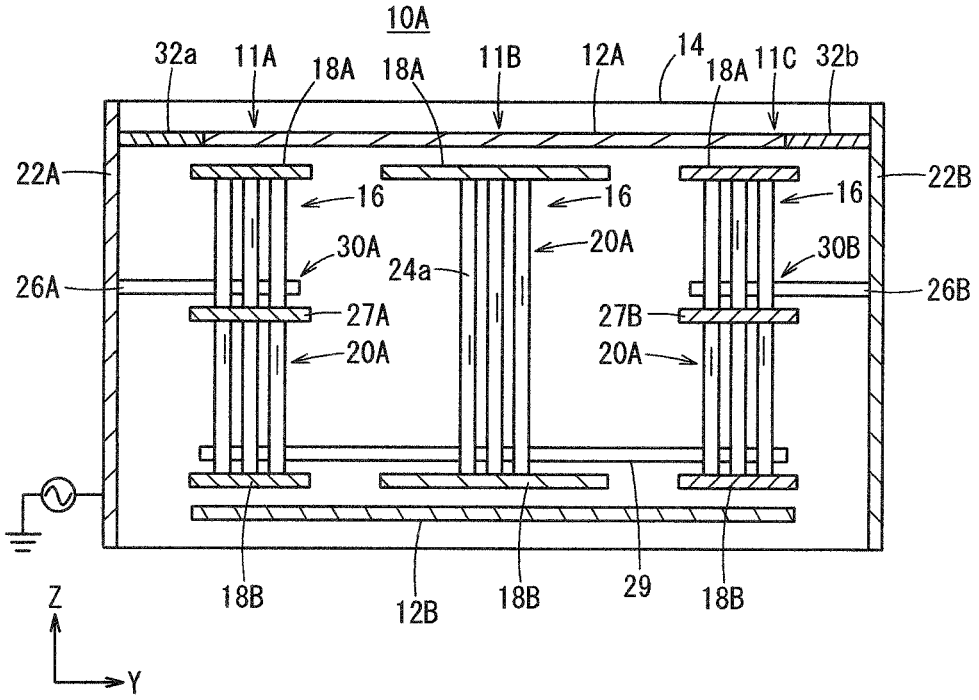
FIGS. 28A and 28B are cross-sectional views showing a filter according to modified example 1 of the second embodiment.
Figure 28B:
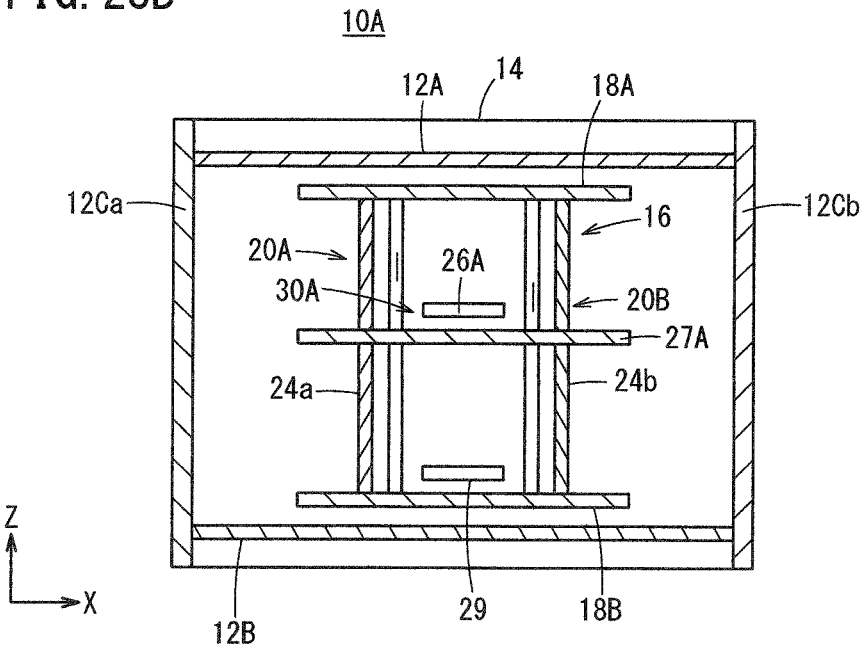

A filter according to modified example 1 of the present embodiment will be described using FIGS. 28A and 28B. FIGS. 28A and 28B are cross-sectional views showing the filter according to the present modified example.

A filter 10A according to the present modified example is one in which the capacitor electrode patterns 27A, 27B are connected to the via electrode portions 20 in the middle in a longitudinal direction of the via electrode portions 20.

As shown in FIGS. 28A and 28B, in the present modified example, the capacitor electrode patterns 27A, 27B are connected to the via electrode portions 20 in the middle in the longitudinal direction of the via electrode portions 20. In the present modified example, the capacitor electrode pattern 26A faces the capacitor electrode pattern 27A of the resonator 11A, and the capacitor electrode pattern 26B faces the capacitor electrode pattern 27B of the resonator 11C. The capacitor electrode pattern 26A, the capacitor electrode pattern 27A of the resonator 11A, and the dielectric existing between these capacitor electrode pattern 26A and capacitor electrode pattern 27A configure the capacitor 30A. The capacitor electrode pattern 26B, the capacitor electrode pattern 27B of the resonator 11C, and the dielectric existing between these capacitor electrode pattern 26B and capacitor electrode pattern 27B configure the capacitor 30B. In this way, the capacitor electrode pattern 27A connected to the via electrode portion 20 of the resonator 11A in the middle in the longitudinal direction of the via electrode portion 20, may be faced by the capacitor electrode pattern 26A. Moreover, the capacitor electrode pattern 27B connected to the via electrode portion 20 of the resonator 11C in the middle in the longitudinal direction of the via electrode portion 20, may be faced by the capacitor electrode pattern 26B.

In the present modified example too, the capacitor 30A is provided between the first input/output terminal 22A and the resonator 11A, and the capacitor 30B is provided between the second input/output terminal 22B and the resonator 11C. In the present modified example too, these capacitors 30A, 30B enable a desired attenuation pole to be formed at a desired frequency position in a vicinity of a pass band, hence the present modified example too enables a filter 10A having good characteristics to be obtained. Moreover, since input/output impedance can be adjusted by these capacitors 30A, 30B, the present modified example too enables inconsistency of input/output impedance to be suppressed. Moreover, such capacitors 30A, 30B have a simple configuration. Hence, the present modified example too makes it possible to provide a filter 10A which is small-sized and has good characteristics.

Modified Example 2

Figure 29A:
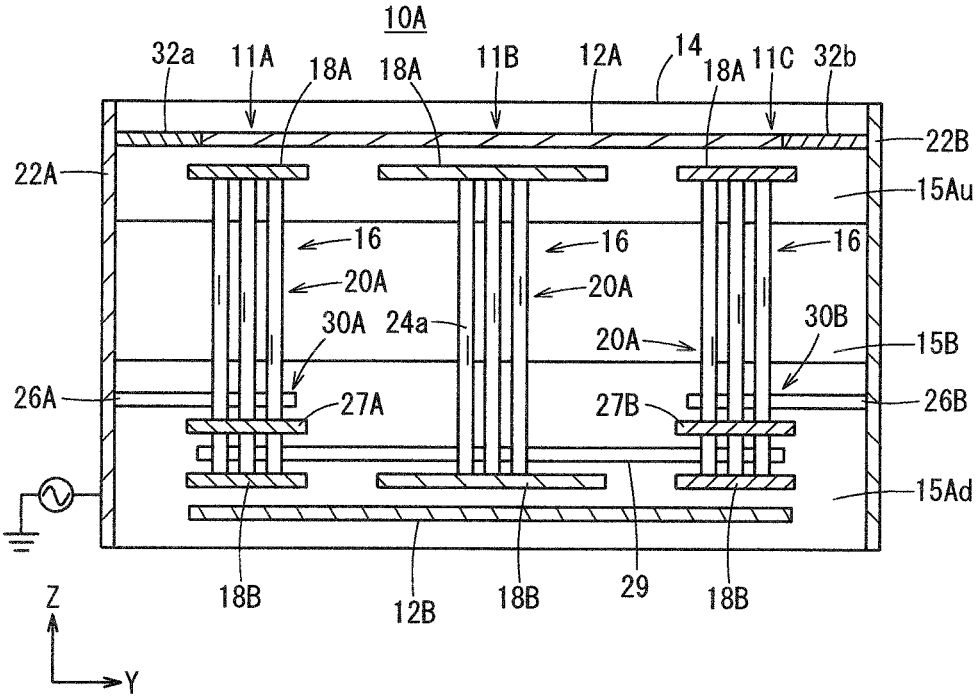
FIGS. 29A and 29B are cross-sectional views showing a filter according to modified example 2 of the second embodiment.
Figure 29B:
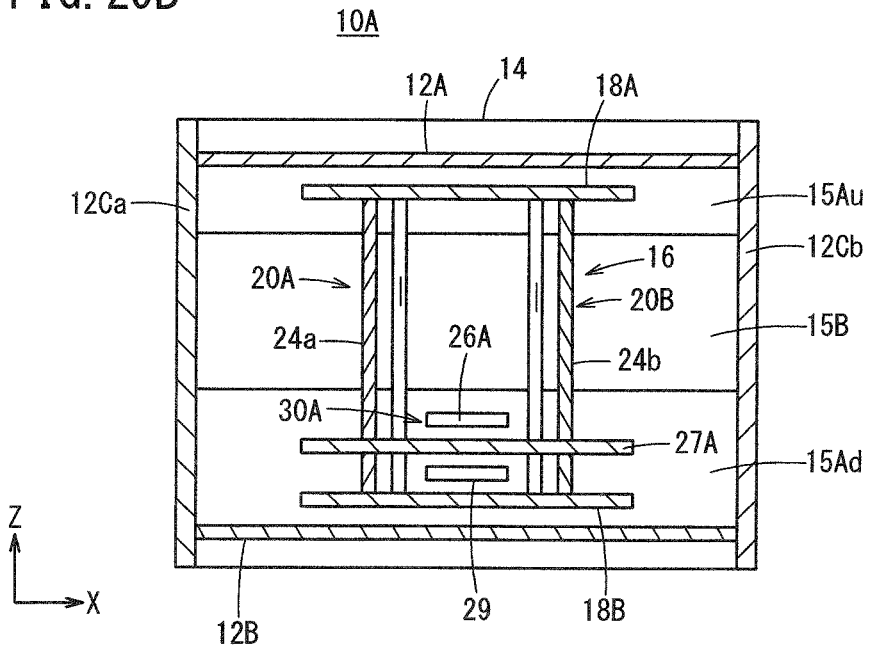

A filter according to modified example 2 of the present embodiment will be described using FIGS. 29A and 29B. FIGS. 29A and 29B are cross-sectional views showing the filter according to the present modified example.

In the present modified example, the dielectric substrate 14 is configured by dielectric layers whose relative dielectric constants differ. In the present modified example, parts of a dielectric layer whose relative dielectric constant is comparatively low are sandwiched between the capacitor electrode patterns 26A, 26B and the strip lines 18 of the resonators 11A, 11C.

As shown in FIGS. 29A and 29B, in the present modified example, the dielectric substrate 14 is configured by: the dielectric layers 15Ad, 15Au whose relative dielectric constants are comparatively low; and the dielectric layer 15B whose relative dielectric constant is comparatively high. The dielectric layer 15B is laminated on the dielectric layer 15Ad, and the dielectric layer 15Au is laminated on the dielectric layer 15B. On one principal surface side being a side where the dielectric layer 15Au is positioned, of the dielectric substrate 14, that is, on an upper side of the dielectric substrate 14 in FIGS. 29A and 29B, there is positioned the upper shielding conductor 12A. On the other principal surface side being a side where the dielectric layer 15Ad is positioned, of the dielectric substrate 14, that is, on a lower side of the dielectric substrate 14 in FIGS. 29A and 29B, there is positioned the lower shielding conductor 12B. Thicknesses of the dielectric layers 15Ad, 15Au may be set to about 200 μm to 300 μm, for example, but are not limited to this. The thickness of the dielectric substrate 14 may be set to about 1.5 mm to 2.0 mm, for example, but is not limited to this.

The lower strip line 18B and the capacitor electrode patterns 26A, 26B are embedded in the dielectric layer 15Ad whose relative dielectric constant is comparatively low. The via electrode portions 20 are embedded at least in the dielectric layer 15B whose relative dielectric constant is comparatively high. The via electrode portions 20 are connected to the lower strip lines 18B within the dielectric layer 15Ad. The via electrode portions 20 are connected to the upper strip lines 18A within the dielectric layer 15Au.

In the present modified example, parts of the dielectric layer 15Ad whose relative dielectric constant is comparatively low are sandwiched between the capacitor electrode patterns 26A, 26B and the capacitor electrode patterns 27A, 27B. Therefore, in the present modified example, even if distance between the capacitor electrode patterns 26A, 26B and the capacitor electrode patterns 27A, 27B varies to a certain extent, variation in electrostatic capacitance of the capacitors 30A, 30B manages to be small. Moreover, even if line width of the capacitor electrode patterns 26A, 26B, 27A, 27B varies to a certain extent, variation in electrostatic capacitance of the capacitors 30A, 30B manages to be small. In addition, in the present modified example, parts of the dielectric layer 15Ad whose relative dielectric constant is comparatively low are sandwiched between the capacitor electrode patterns 27A, 27B and the coupling capacitance electrode 29. Therefore, in the present modified example, even if distance between the capacitor electrode patterns 27A, 27B and the coupling capacitance electrode 29 varies to a certain extent, variation in electrostatic capacitance between these capacitor electrode patterns 27A, 27B and coupling capacitance electrode 29 manages to be small. Moreover, even if line width of the capacitor electrode patterns 27A, 27B or the coupling capacitance electrode 29 varies to a certain extent, variation in electrostatic capacitance between these capacitor electrode patterns 27A, 27B and coupling capacitance electrode 29 manages to be small. In addition, in the present modified example, parts of the dielectric layer 15Ad whose relative dielectric constant is comparatively low are sandwiched between the coupling capacitance electrode 29 and the lower strip lines 18B. Therefore, in the present modified example, even if distance between the coupling capacitance electrode 29 and the lower strip lines 18B varies to a certain extent, variation in electrostatic capacitance between these coupling capacitance electrode 29 and lower strip lines 18B manages to be small. Moreover, even if line width of the coupling capacitance electrode 29 or the lower strip lines 18B varies to a certain extent, variation in electrostatic capacitance between these coupling capacitance electrode 29 and lower strip lines 18B manages to be small. Therefore, due to the present modified example, variation in filter characteristics can be reduced.

In the present modified example, parts of the dielectric layer 15Au whose relative dielectric constant is comparatively low are sandwiched between the upper strip lines 18A and the upper shielding conductor 12A. Moreover, parts of the dielectric layer 15Ad whose relative dielectric constant is comparatively low are sandwiched also between the lower strip lines 18B and the lower shielding conductor 12B. Therefore, in the present modified example too, area of the strip lines 18A, 18B can be secured in large measure. Therefore, degree of freedom of layout of patterns of the coupling capacitance electrode 29, and so on, provided between the resonators 11A to 11C can be enhanced. Moreover, since area of the strip lines 18A, 18B is secured in large measure, resonators 11A to 11C using pluralities of the via electrodes 24*a*, 24*b* can be realized. Therefore, due to the present modified example, resonators 11A to 11C that are good and have a high Q-factor can be obtained.

In the present modified example, the via electrode portions 20 are embedded in the dielectric layer 15B whose relative dielectric constant is comparatively high. Therefore, in the present modified example, a wavelength shortening effect may be obtained in the portions. Therefore, due to the present modified example, a transmission line can be shortened, and a contribution can be made to downsizing of the filter 10A.

The above-described embodiments may be summarized as follows.

The filter (10) includes: the resonator (11A), the resonator including the via electrode portion (20) which is formed within the dielectric substrate (14), and the resonator including the first strip line (18, 183) which is connected to one end of the via electrode portion and which faces the first shielding conductor (12B) among the plurality of shielding conductors (12A, 12B, 12Ca, 12Cb) that are formed so as to surround the via electrode portion; the input/output terminal (22A) which is coupled to the second shielding conductor (12A) among the plurality of shielding conductors; and the first capacitor electrode pattern (26A) which is connected to the input/output terminal, the first capacitor electrode pattern being capacitively coupled to the second capacitor electrode pattern (27A) which is connected to the via electrode portion, or being capacitively coupled to the first strip line. Due to such a configuration, a capacitor is formed between the input/output terminal and the resonator. Such a capacitor enables a desired attenuation pole at a desired frequency position to be formed in a vicinity of a pass band, hence such a configuration enables a filter having good characteristics to be obtained. Moreover, since input/output impedance can be adjusted by such a capacitor, such a configuration enables inconsistency of input/output impedance to be suppressed. Moreover, such a capacitor has a simple configuration. Hence, such a configuration makes it possible to provide a filter which is small-sized and has good characteristics.

A configuration may be adopted whereby the first capacitor electrode pattern faces the second capacitor electrode pattern or the first strip line.

A configuration may be adopted whereby the first capacitor electrode pattern is capacitively coupled to the second capacitor electrode pattern or the first strip line via the gap (33A).

A configuration may be adopted whereby the first capacitor electrode pattern faces a coupling capacitance electrode (31A) which is formed so as to face the second capacitor electrode pattern or the first strip line.

A configuration may be adopted whereby the other end of the via electrode portion is connected to the second shielding conductor.

A configuration may be adopted whereby there is further included the second strip line (18A) which is connected to the other end of the via electrode portion and which faces the second shielding conductor, within the dielectric substrate. Due to such a configuration, the resonator may operate as a $\lambda/2$ resonator. Due to such a configuration, a local concentration of current is prevented from occurring in the first shielding conductor and the second shielding conductor, and meanwhile, current can be concentrated in a vicinity of a center of the via electrode portion. Since it is the via electrode portion alone where current concentrates, that is, since current concentrates where there is continuity (linearity), such a configuration enables the Q-factor to be improved.

A configuration may be adopted whereby the first shielding conductor is formed on one principal surface side of the dielectric substrate, and the second shielding conductor is formed on the other principal surface side of the dielectric substrate.

A configuration may be adopted whereby the dielectric substrate includes the first dielectric layer (15A) and includes the second dielectric layer (15B) that has a higher relative dielectric constant than the first dielectric layer, part of the first dielectric layer is sandwiched between the first capacitor electrode pattern and the second capacitor electrode pattern or between the first capacitor electrode pattern and the first strip line, and the via electrode portion is formed at least within the second dielectric layer. Due to such a configuration, part of the first dielectric layer whose relative dielectric constant is comparatively low is sandwiched between the first capacitor electrode pattern and the second capacitor electrode pattern or between the first capacitor electrode pattern and the first strip line. Therefore, even if distance between the first capacitor electrode pattern and the second capacitor electrode pattern or distance between the first capacitor electrode pattern and the first strip line varies to a certain extent, change in electrostatic capacitance of the capacitor manages to be small. Moreover, even if line width of the first capacitor electrode pattern, the second capacitor electrode pattern, or the first strip line varies to a certain extent, change in electrostatic capacitance of the capacitor manages to be small. Therefore, due to such a configuration, variation in electrical characteristics can be reduced. Moreover, due to such a configuration, the via electrode portion is embedded in the second dielectric layer whose relative dielectric constant is comparatively high, hence a wavelength shortening effect may be obtained in the portion. Therefore, due to such a configuration, a transmission line can be shortened, and a contribution can be made to downsizing of the filter.

A configuration may be adopted whereby the via electrode portion is configured from the plurality of via electrodes (24*a*, 24*b*).

A configuration may be adopted whereby the via electrode portion includes the first via electrode portion (20A) and the second via electrode portion (20B).

A configuration may be adopted whereby the first via electrode portion is configured from the plurality of first via electrodes, the second via electrode portion is configured from the plurality of second via electrodes, and no other via electrode portion exists between the first via electrode portion and the second via electrode portion. Due to such a configuration, since no other via electrode portion exists between the first via electrode portion and the second via electrode portion, a time required for forming the vias can be shortened, and, consequently, an improvement in throughput can be achieved. Moreover, due to such a configuration, since no other via electrode portion exists between the first via electrode portion and the second via electrode portion, a material such as silver embedded in the vias may be reduced, and, consequently, a reduction in costs can also be achieved. Moreover, since a region where an electromagnetic field is comparatively sparse is formed between the first via electrode portion and the second via electrode portion, it is also possible for a pattern for coupling adjustment, and so on, to be formed in the region.

A configuration may be adopted whereby the plurality of first via electrodes are disposed along the first imaginary curved line (28*a*), when viewed from an upper surface, and the plurality of second via electrodes are disposed along the second imaginary curved line (28*b*), when viewed from an upper surface.

A configuration may be adopted whereby the first curved line and the second curved line configure part of a single ellipse or part of a single track shape.

Preferred embodiments of the present invention have been presented and described above. However, the present invention is not limited to the above-described embodiments, and a variety of modifications are possible within a range not departing from the gist of the present invention.

REFERENCE SIGNS LIST

10: filter
11A to 11C: resonator
12A: upper shielding conductor
12B: lower shielding conductor
12Ca: first side surface shielding conductor
12Cb: second side surface shielding conductor
14: dielectric substrate
15A, 15B: dielectric layer
16: structure
18: strip line
18A: upper strip line
18B: lower strip line
20: via electrode portion
20A: first via electrode portion
20B: second via electrode portion
20C: third via electrode portion
22A: first input/output terminal
22B: second input/output terminal
24*a*: first via electrode
24*b*: second via electrode
24*c*: third via electrode
26A, 26B, 27A, 27B: capacitor electrode pattern
28*a*: first imaginary curved line
28*b*: second imaginary curved line
29, 31A, 31B: coupling capacitance electrode
30A, 30B: capacitor
33A, 33B: gap
34: imaginary rhombus
37: imaginary ellipse
38: imaginary track shape

The invention claimed is:

1. A filter comprising:

a resonator including a via electrode portion, which is formed within a dielectric substrate, and a first strip line, which is connected to one end of the via electrode portion, and which faces a first shielding conductor among a plurality of shielding conductors that are formed so as to surround the via electrode portion;

an input/output terminal, which is directly connected to a second shielding conductor among the plurality of shielding conductors; and a first capacitor electrode pattern, which is coupled to the input/output terminal, the first capacitor electrode pattern being capacitively coupled to a second capacitor electrode pattern, which is connected to the via electrode portion, or being capacitively coupled to the first strip line.

2. The filter according to claim 1, wherein the first capacitor electrode pattern faces the second capacitor electrode pattern or the first strip line.

3. The filter according to claim 1, wherein the first capacitor electrode pattern is capacitively coupled to the second capacitor electrode pattern or the first strip line via a gap.

4. The filter according to claim 1, wherein the first capacitor electrode pattern faces a coupling capacitance electrode which is formed so as to face the second capacitor electrode pattern or the first strip line.

5. The filter according to claim 1, wherein another end of the via electrode portion is connected to the second shielding conductor.

6. The filter according to claim 1, wherein the first shielding conductor is fanned on one principal surface side of the dielectric substrate, and wherein the second shielding conductor is formed on another principal surface side of the dielectric substrate.

7. The filter according to claim 1, wherein the via electrode portion is configured from a plurality of via electrodes.

8. The filter according to claim 7, wherein the via electrode portion includes a first via electrode portion and a second via electrode portion.

9. The filter according to claim 8, wherein the first via electrode portion is configured from a plurality of first via electrodes, wherein the second via electrode portion is configured from a plurality of second via electrodes, and wherein no other via electrode portion exists between the first via electrode portion and the second via electrode portion.

10. The filter according to claim 9, wherein the plurality of first via electrodes are disposed along a first imaginary curved line, when viewed from an upper surface, and wherein the plurality of second via electrodes are disposed along a second imaginary curved line, when viewed from an upper surface.

11. The filter according to claim 10, wherein the first curved line and the second curved line configure part of a single ellipse or part of a single track shape.

12. A filter comprising:

a resonator including a via electrode portion, which is formed within a dielectric substrate, and a first strip line, which is connected to one end of the via electrode portion, and which faces a first shielding conductor among a plurality of shielding conductors that are formed so as to surround the via electrode portion;

an input/output terminal which is coupled to a second shielding conductor among the plurality of shielding conductors; and a first capacitor electrode pattern, which is coupled to the input/output terminal, the first capacitor electrode pattern being capacitively coupled to a second capacitor electrode pattern, which is connected to the via electrode portion, or being capacitively coupled to the first strip line, and wherein the resonator further includes a second strip line, which is connected to the other end of the via electrode portion, and which faces the second shielding conductor, within the dielectric substrate.

13. A filter comprising:

a resonator including a via electrode portion, which is formed within a dielectric substrate, and a first strip line, which is connected to one end of the via electrode portion, and which faces a first shielding conductor among a plurality of shielding conductors that are formed so as to surround the via electrode portion;

an input/output terminal which is coupled to a second shielding conductor among the plurality of shielding conductors; and a first capacitor electrode pattern, which is coupled to the input/output terminal, the first capacitor electrode pattern being capacitively coupled to a second capacitor electrode pattern, which is connected to the via electrode portion, or being capacitively coupled to the first strip line, wherein the dielectric substrate includes a first dielectric layer and includes a second dielectric layer that has a higher relative dielectric constant than the first dielectric layer, wherein part of the first dielectric layer is sandwiched between the first capacitor electrode pattern and the second capacitor electrode pattern, or between the first capacitor electrode pattern and the first strip line, and wherein the via electrode portion is formed at least within the second dielectric layer.

* * * * *